US006494156B1

(12) United States Patent
Robinson

(10) Patent No.: US 6,494,156 B1
(45) Date of Patent: Dec. 17, 2002

(54) METHOD AND APPARATUS FOR PREVENTING CARGO SPILLS

(76) Inventor: Keith A. Robinson, 2409 Bering, Unit 19, Houston, TX (US) 77057

( * ) Notice: Subject to any disclaimer, the term of this patent is extended or adjusted under 35 U.S.C. 154(b) by 0 days.

(21) Appl. No.: 09/676,900

(22) Filed: Oct. 2, 2000

Related U.S. Application Data

(60) Provisional application No. 60/165,421, filed on Nov. 13, 1999.

(51) Int. Cl.[7] ..... B63B 25/08
(52) U.S. Cl. ..... 114/74 R; 114/74 A
(58) Field of Search ..... 114/72, 74 R, 114/74 A; 244/31

(56) References Cited

U.S. PATENT DOCUMENTS 3,369,774 A * 2/1968 Struble, Jr. ..... 244/31
3,906,880 A 9/1975 Hebert
4,230,061 A * 10/1980 Roberts et al. ..... 114/74 A
4,484,533 A 11/1984 David
4,960,347 A 10/1990 Strange
5,363,787 A * 11/1994 Konopasek et al. ..... 114/74 A
6,152,059 A 11/2000 Del Raso

* cited by examiner

*Primary Examiner*—Stephen Avila
(74) *Attorney, Agent, or Firm*—Robert W. Strozier

(57) ABSTRACT

A non-permeable bladder is used for transporting oil within a steel compartment onboard an oil tanker. The bladder is contained within a meso-skeleton suspended within the individual metal tank which causes any force which would otherwise puncture the bladder, to be spread evenly over the exterior of the bladder and causes the fluid within the bladder to be expelled through a check valve into one or more smaller containers which can either be maintained onboard the oil tanker or forced into the water through which the tanker had been moving.

24 Claims, 22 Drawing Sheets

Fig. 17B
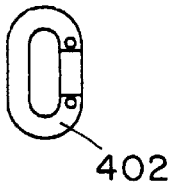
Fig. 17C
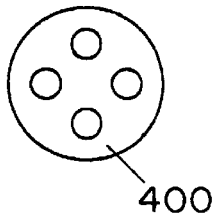
Fig. 17D
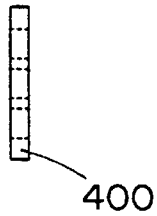
Fig. 17A
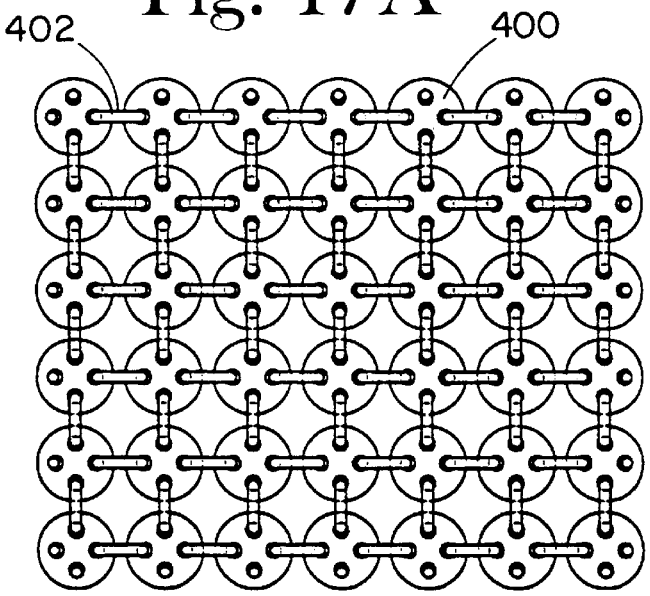
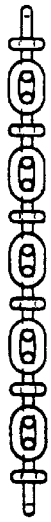
Fig. 17E

METHOD AND APPARATUS FOR PREVENTING CARGO SPILLS

RELATED APPLICATION

This application claims priority from U.S. Provisional Patent Application Ser. No. 60/165,421, filed on Nov. 13, 1999, entitled Method and Apparatus for Preventing Cargo Spills, filed by and on behalf of Keith A. Robinson.

BACKGROUND OF THE INVENTION

The History of Petrochemical Transportation

Because of the wide diversity of locations where oil is harvested from earths' underground reservoirs, it is necessary to transport the crude oil from a land or sea-based location to many sites across the globe for refinement. History books have recorded massive spillage of crude and catastrophic ecological damage during this transportation phase because of hull failure of the vessel transporting the crude. While oil spill prevention is the primary purpose of this invention, the invention contemplates the prevention of spills of various types of liquids and gasses, primarily in the petrochemical industry.

Currently Used Technology

Currently, only one transport process is being considered to significantly lower the risk of ecological damage resulting from the breach in the hull integrity of petrochemical transport vehicles: The Double Hull. Oil tankers built now and in the future are required by the Oil Pollution Act of 1990 (OPA '90) to use double hulled construction to reduce the risk of oil spills due to grounding and collision, and the resulting adverse impact on the environment. Although the use of double hulls is a step in the right direction, it does not fully eliminate the likelihood of oil spills since the inner hull can still be penetrated in major accidents. Major oil spills, such as the 1989 Exxon Valdez oil tanker spill at Bligh Reef in Prince William Sound, Alaska, can have devastating impacts on the environment, and the cost of oil recovery and restoration of the environment can be extremely high. Although the double hull is currently perceived by the public and political figures as the most "politically correct" solution to the problem, after lengthy review of the options available, the double-hull concept is flawed and still capable of failure for the same reasons as the single hull. Even with the destruction of the entire remaining existing fleet of tankers, barges, and intermediate vessels and the expenditure of billions of dollars for the construction of The Double-Hull vessels, it is a fact that the Double-Hull vessel is still capable of being pierced or crushed by an incoming object when the force of that object exceeds the strength of the hulls. The Double-hull proponents merely hope that two hulls are enough. Recent history reaffirms that even two hulls are not enough. Even with this knowledge, the petrochemical industry, driven by legislative momentum, a massively powerful and financially well-endowed lobbying organization and the ongoing voluntary implementation of the Double-Hull vessels into the current transportation, there appears to be a feeling among the major petrochemical interests that the cost of correcting the flaw in the vessel construction problem would not find a receptive market. Once again, the industry appears to accept petrochemical cargo spillage as "another risk of doing business."

Previous patents have struggled admittedly to only minimize the risk of hull breach with the use of various forms of bladders and reinforcement. Yet, each such patent admits that the loss of cargo would occur should both the bladder and its reinforcement be pierced during a hull breach.

This present invention allows the existing fleet of small, medium and large, single-hull and double-hull vessels that function as petrochemical transport vessels on various scales of magnitude, and VLCC (Very Large Crude Carriers) having single hulls to be converted and retrofitted to become more ecologically safe and physically predictable to unexpected hull pressures. Because of the custom nature of this invention, it is applicable to varying sizes of vessels.

Some of the Savings Expected By Using Existing Retrofitted Vessels

By using the existing retrofitted vessels with this invention:

1) Literally billions of dollars will be saved that would have been used in constructing the new and vastly more expensive replacement vessels. The money saved can be invested at a much higher rate of return yielding greater profits than would have been lost in the purchase of new vessels before the existing ones actually require replacement due to extinction or mechanical failures.
2) The additional fuel necessary to move the heavier mass of double-hull tankers will be conserved while payload volume of transported crude will be maintained. When this savings is considered for every journey of every vessel during the lifetime of the vessel until mandatory replacement, this is a major environmental and financial savings making worldwide utilization of this invention even more feasible.
3) The ship scrap debris created from the unnecessary destruction (usually sinking to the ocean floor) of the entire world fleet of tankers will lessen the environmental impact on the world's refuse problem and the presence of sea-junk with its oxidation and ionic release into the sea.
4) And, the industry will have finally dealt with the actual petrochemical transport containment issues rather than just minimizing the risk but admitting the potential for failure of the other containment inventions. The potential damage to the environment as well as the financial outlay for clean-up or bio-remediation of spilled product is just too great to risk by not dealing with the actual problem at hand.

Positive Aspects of Utilizing This Invention

There are many positive reasons for utilization of this invention within the existing fleet of single-hull tankers that have been retrofitted with this present invention;

1) Improvement of existing vessels to deal with unexpected hull integrity problems;
2) Prevention of ecological tragedy that accompanies petrochemical spills;
3) Re-integration of vessel transport cell integrity following a hull breach where sea water enters the vessel;
4) Pre-Containment of Off-loaded crude;
5) Multiple-back-up system for off-loading of over-pressurized compartment contents;
6) Installation of invention with minimal time of vessel out of service;
7) Lower vessel hold maintenance costs;
8) Ability to change cargo type with more ease and safety from cross-contamination;
9) More safety to cleaning personnel of transport cells; and
10) Ability to protect off-loaded product from harm's way.

SUMMARY OF THE INVENTION

An object of the present invention is to provide an improved cargo ship.

Another object of the present invention is to prevent hydrocarbon spills, or spills of other types of cargo, in the event the hull of a ship is breached.

An advantage of the present invention is a means for containing a hydrocarbon cargo, or other type of cargo, even after the hull or double hull of a ship is breached.

In the preferred embodiment of the invention, a method and apparatus are provided for containing cargo carried aboard a cargo carrier comprising a non-permeable, flexible bladder mounted within the carrier and in which the cargo is disposed and having an outlet port containing one or more check valves which allow the transported cargo to exit through such one or more check valves in the event the bladder is contacted by one or more objects which would otherwise cause the bladder to burst and spill the contents.

Therefore, in one embodiment the invention discloses an apparatus for containing cargo during a hull breach on a ship which comprises a non-permeable, flexible bladder mounted within the ship in which the cargo is disposed and a skeleton adjacent to the flexible bladder comprised of a plurality of relatively moveable elements for supporting the flexible bladder. The skeleton may be flexible and conformable to a shape of the flexible bladder. The plurality of relatively moveable elements forming the skeleton, in one embodiment, may comprise metallic links and/or metallic plates. There may be interconnecting metallic links mounted to the metallic plates.

This it should be appreciated that there has been described and illustrated herein new and improved methods and apparatus for preventing the spill of transported cargo aboard an oil tanker. However, the invention contemplates the use of such methods and apparatus for preventing the spills of various cargo materials on other means of transportation, for example, on barges, air craft which are used as tankers for refueling other aircraft while in flight, tanker trucks which are used to transport oil or other fluid cargos over the highway system, and the like.

The invention may include means for permitting flow from the bladder to compensate for a sudden increase in pressure in the bladder caused by a hull breach. In one embodiment, a pressure sensitive valve is secured to the non-permeable flexible bladder. One or more pressure sensitive valves is operable to open to release the cargo in response to a sudden increase in pressure in the non-permeable bladder due to the hull breach. The valve may close once the pressure is reduced to a normal value to seal the remaining cargo within the flexible bladder.

In one presently preferred embodiment, a plurality of tanks are provided wherein each tank may be much smaller than the flexible bladder. The pressure sensitive valve may then release the cargo into the plurality of tanks to take care of the overflow due to the hull breach. Preferably, each of the plurality of tanks is expandable so that storage is compact. A header may be provided for receiving the cargo from the pressure sensitive valve responsive to the hull breach. As the header is filled, the expandable tanks are filled with the excess.

In operation, the present invention provides methods for containing cargo during a hull breach on a ship. The method may comprise such steps as releasing cargo from a flexible container through a valve in response to increased pressure in the flexible container produced by the hull breach and directing the released cargo into the header on the ship. The method may comprise other steps such as filling at least one expandable tank, preferably with the released cargo in the header and may comprise releasing the at least one expandable tank over board after being filled with the released cargo. The method preferably includes supporting the flexible container with a plurality of support elements flexibly interconnected together.

In other words, an apparatus is provided for containing cargo during a hull breach on a ship which preferably comprises elements such as a non-permeable bladder mounted within the ship in which the cargo is disposed, a flexible support structure in surrounding relationship to the non-permeable bladder, and a valve secured to the bladder. The valve is preferably operable to open for releasing the cargo through the valve responsive to a hull breach. The flexible support structure may take on many forms such as a plurality of elements moveably linked together. In a preferred embodiment, at least one expandable tank may be provided which is placed in communication with the valve for filling in response to the hull breach. In one embodiment of the invention, the valve is responsively opened by an increase in pressure caused by the hull breach. A header pipe is secured to the valve for receiving the cargo and directing the cargo, if necessary, to a plurality of expandable tanks which are secured to the header for receiving the cargo therefrom.

BRIEF DESCRIPTION OF THE DRAWINGS

FIGS. 17 (A)–(E) illustrates a meso-skeleton configuration of steel plates and steel chain links which provide a portion of the preferred embodiment of the present invention;

DETAILED DESCRIPTION OF THE INVENTION

Figure 1:
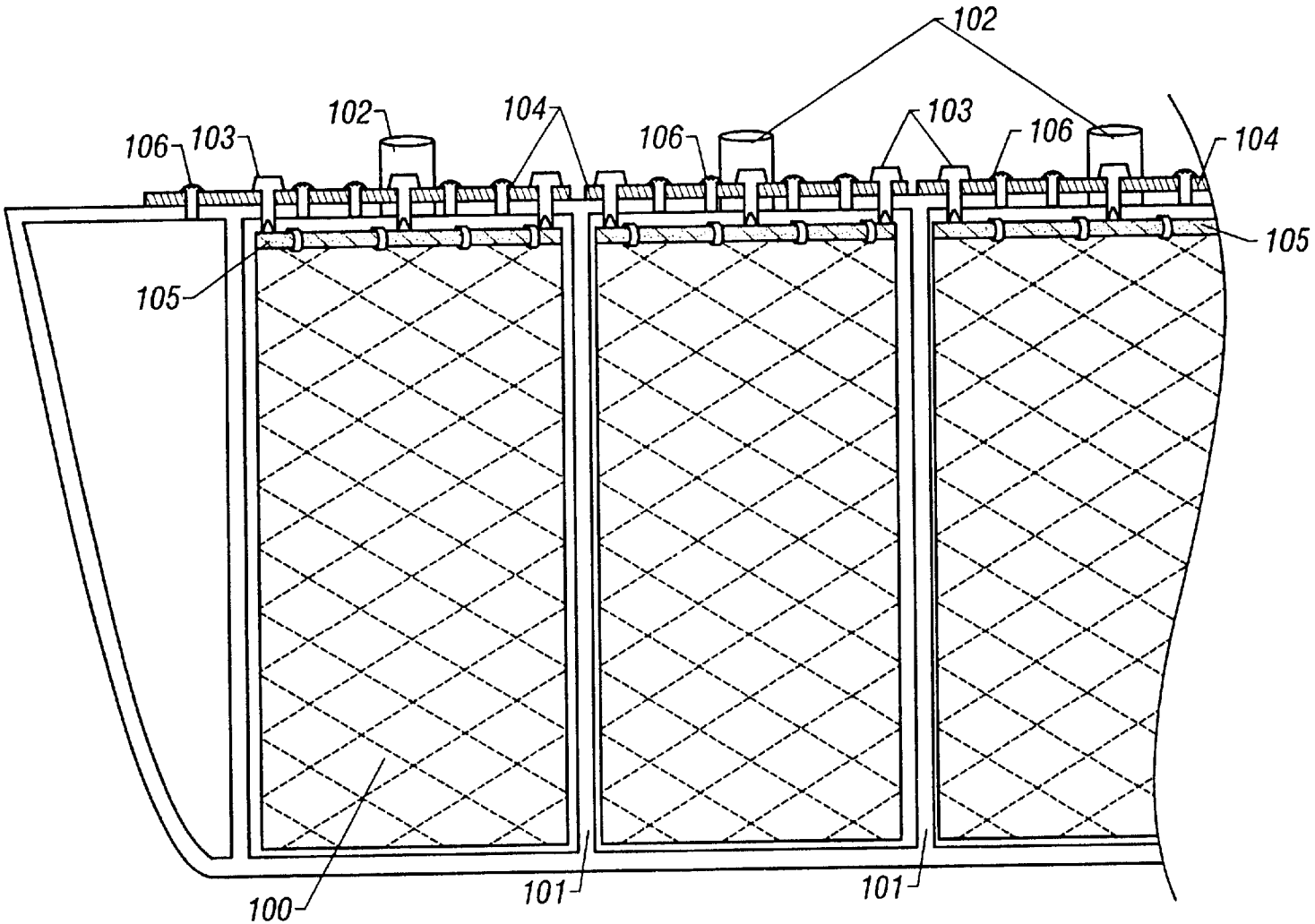
FIG. 1 is cut away view of a ship hull containing the apparatus according to the present invention.

The following definitions are used in describing this invention:

Meso-skeleton is the protective, intentionally deformable infrastructure that has been developed to lay passively against the ships hull in the hold. The meso-skeleton occupies minimal space in the hold yet provides an important force distribution protective function at the moment of hull breach.

Meso-skeleton elements (add as FIG. 1A the Triangle with the knuckle joints) have tubular members 200 with meso-skeleton element joints, articulating condyle member 201, and also knuckle joints 202. Further the tubular members have sleeves 204 over the tubular members.

Meso-skeleton element joints 202 are shaped as a knuckle that will allow the three contacting ball elements of adjoining meso-skeleton elements to have wide range of motions in multiple axes.

Skeleton strips (not shown) are created using a connecting sleeve (not shown) that in a preferred embodiment can be latched over tubular members 200 to connect two tubular members together creating the meso-skeleton 100 using Sleeve Connectors 205, otherwise, the knuckle/meso-skeleton element joints join the basic elements together.

Figure 2:
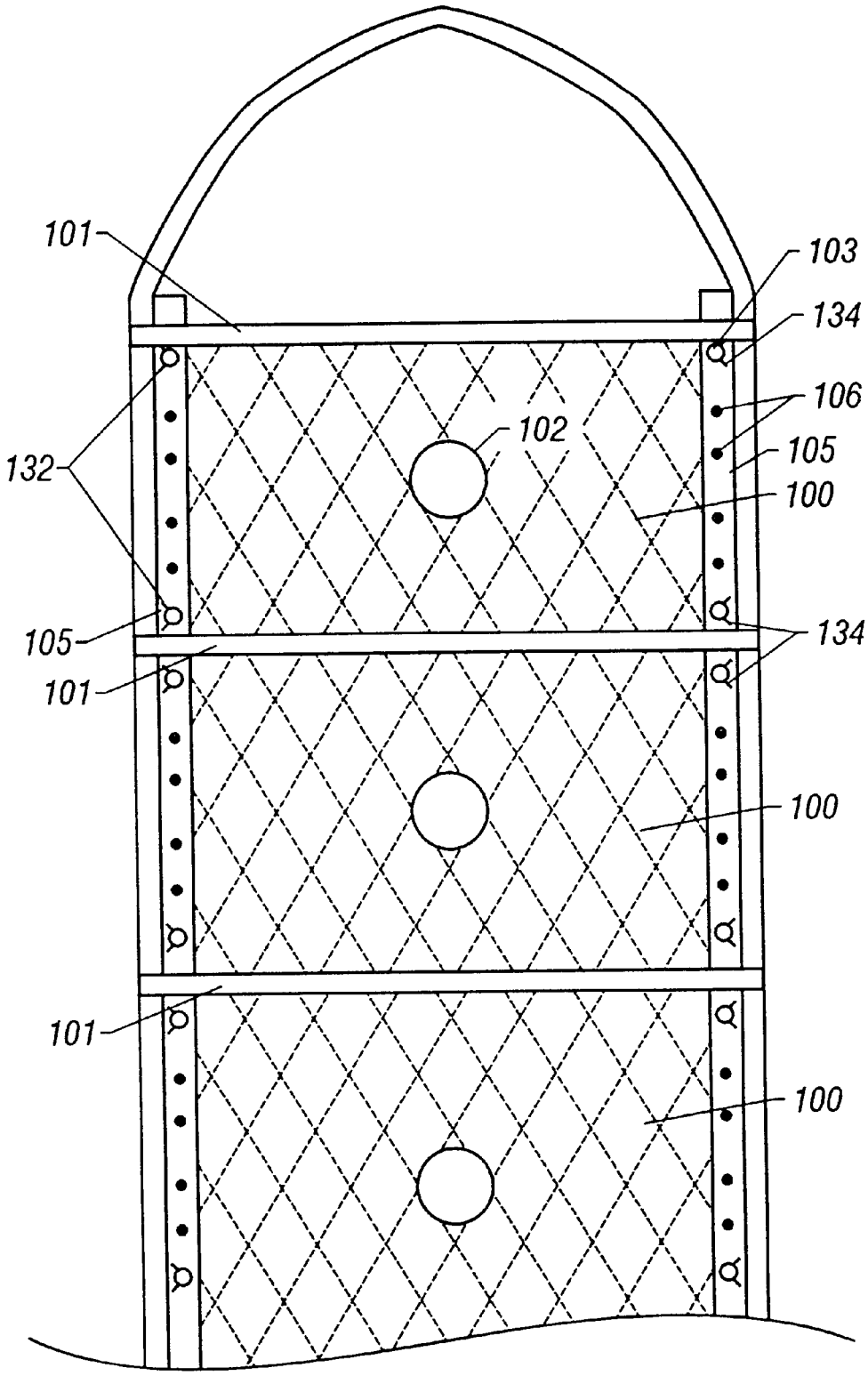
FIG. 2 is a top view of a ship without the deck showing the deck hull hanging device and the meso-skeleton structure according to the present invention.

FIG. 2 shows the Deck hull hanging device 103 having a rod 105, at least one plate 104, but preferably a plurality of plates. There are intermediate rivets 106 that attach the plate to the deck's hull and support structure.

The ships bulkheads 101 serve as interrupters of cells into functioning units.

Figure 3:
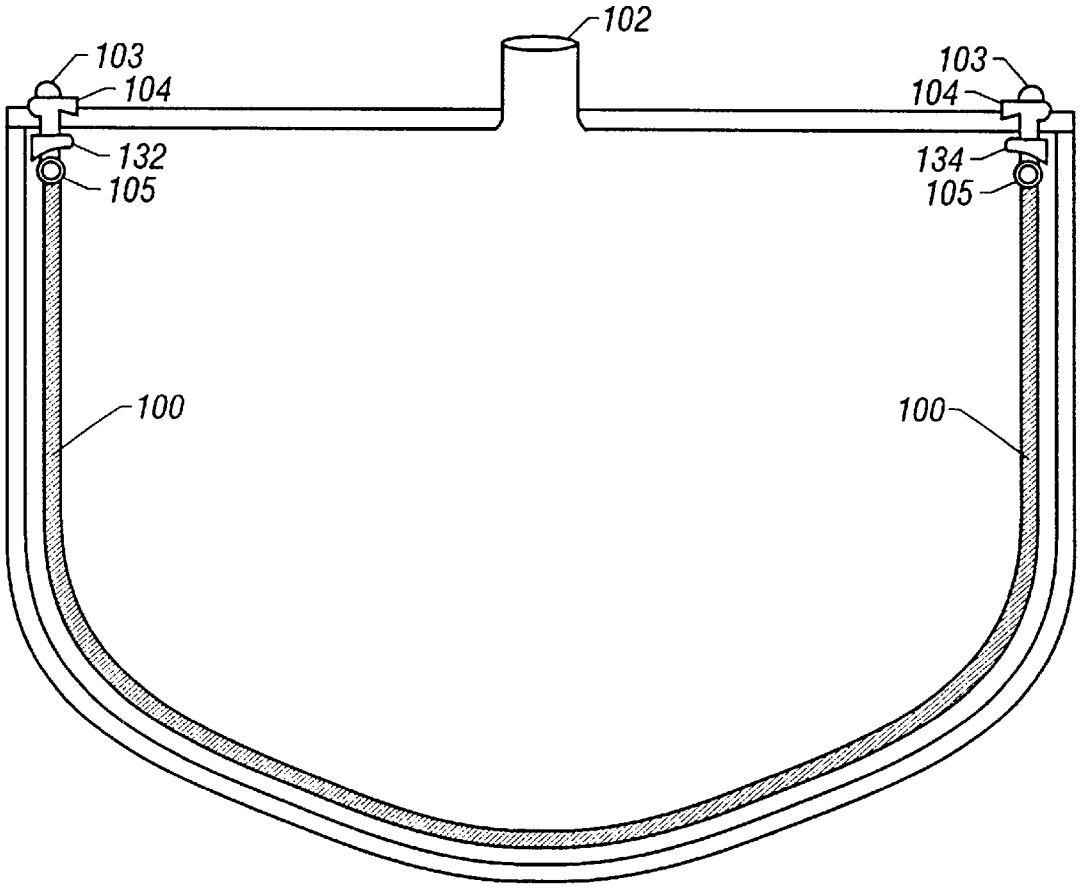
FIG. 3 is a view of the meso-skeleton structure of the present invention installed in a ship and viewed from one end (stern view) of the ship.

FIG. 3 shows the deck hull hanging device 103 with at least two support struts 132 and 134.

Figure 4:
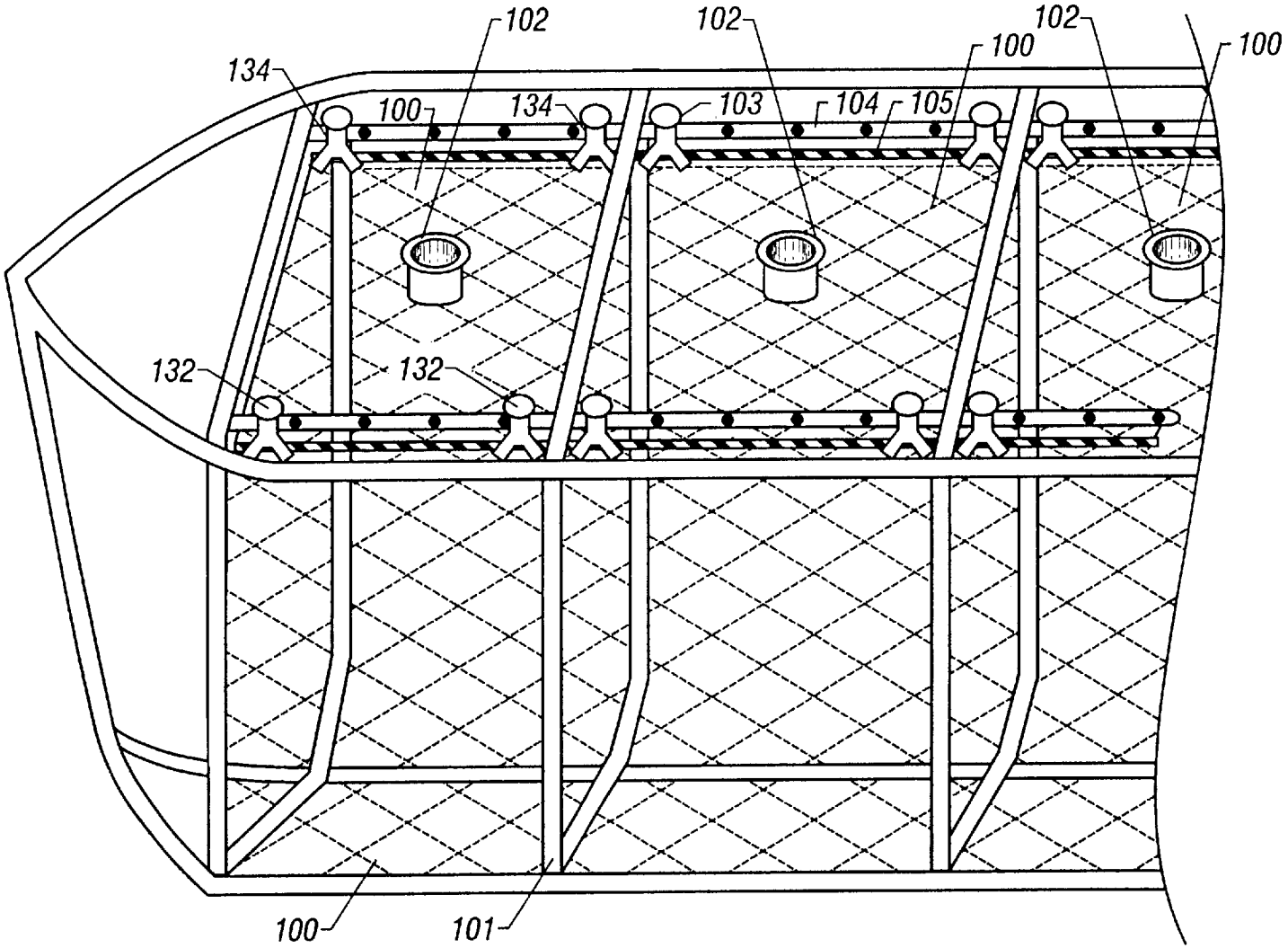
FIG. 4 is a perspective view of the meso-skeleton according to the present invention installed in the hull of a ship.

FIG. 4 shows the entry port 102 for the bladder attached to the deck hull.

Figure 5:
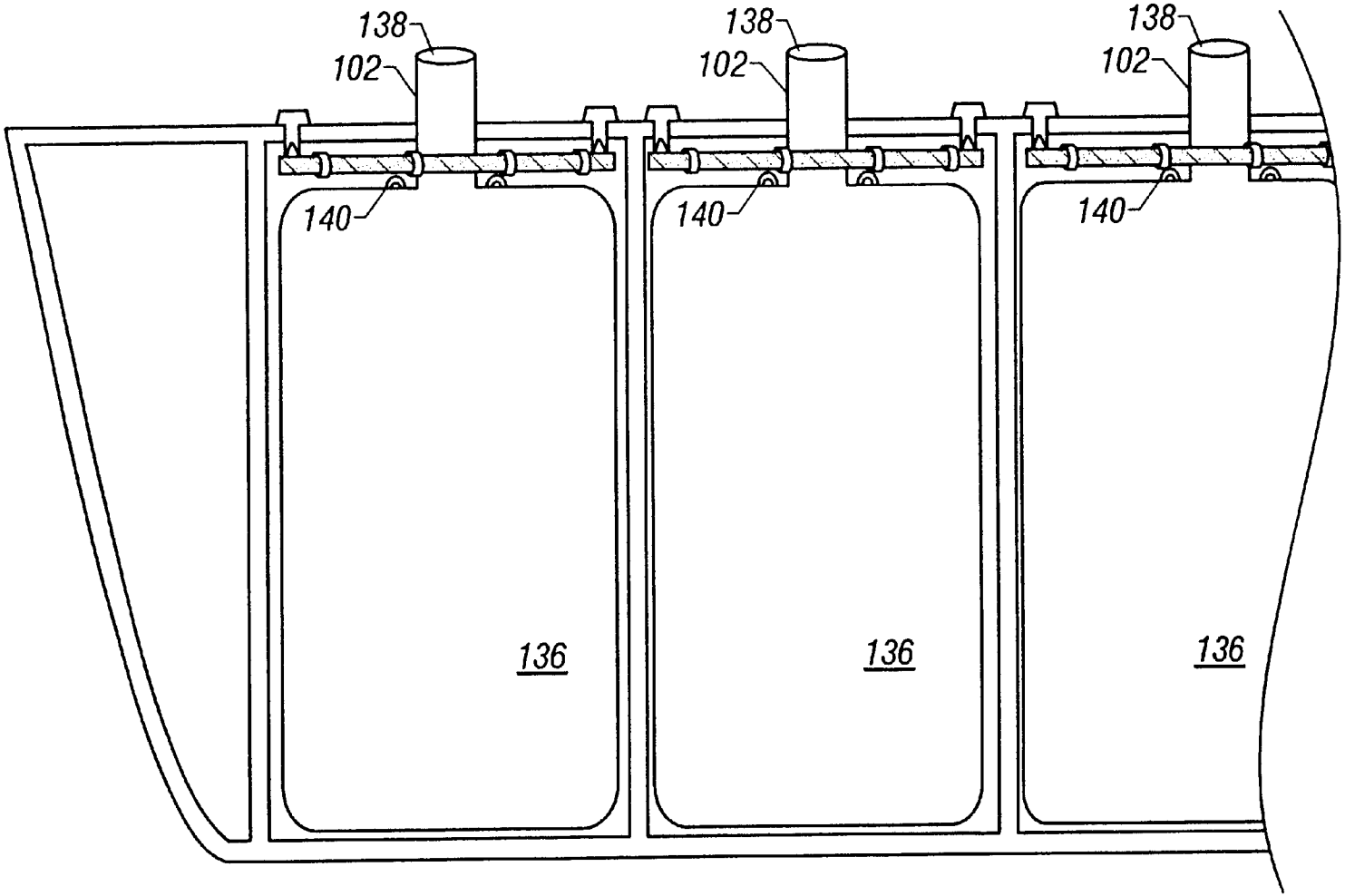
FIG. 5 is a side view of a ship showing the bladder according to the present invention in the ship.
Figure 6:
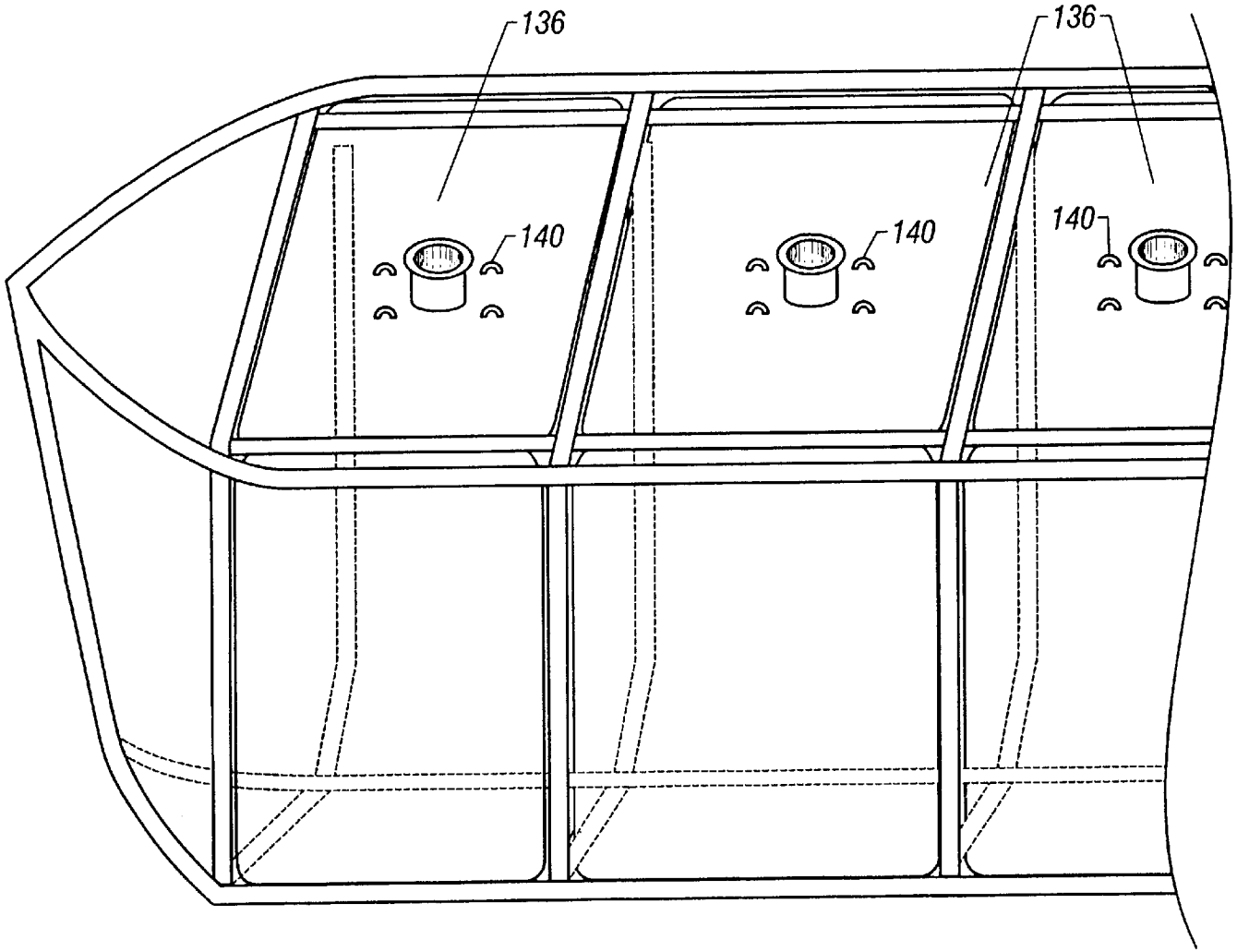
FIG. 6 is a perspective view of the containment system in the hull of a ship with the bladder and meso-skeleton installed.

FIGS. 5 and 6 show bladder 136 contained in the hold of a ship.

Bladder neck 138 is positioned to extend up into the port 102.

Figure 7:
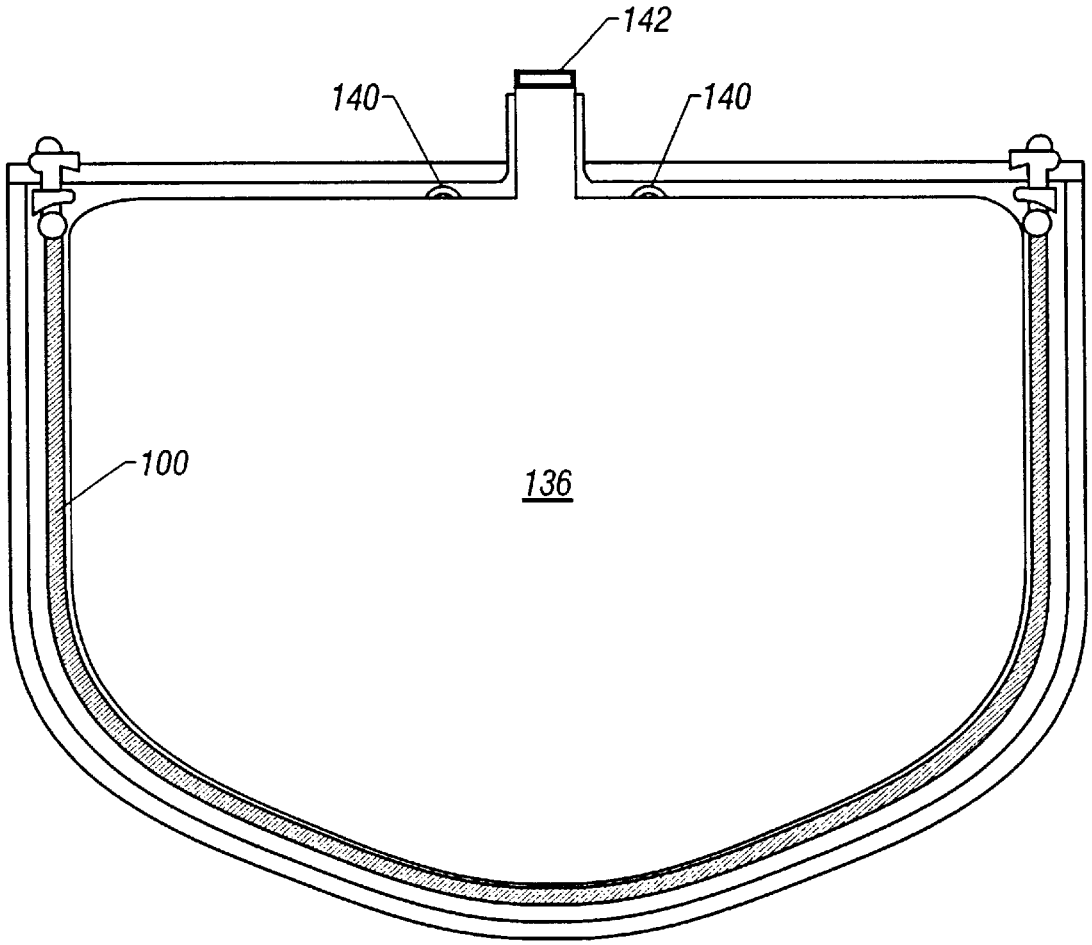
FIG. 7 is an end view of a ship showing the bladder and meso skeleton installed in the ship with the transported product in the bladder.

FIG. 7 shows the bladder support means 140. The pressure sensitive valve 142 is shown as well.

Figure 1A:
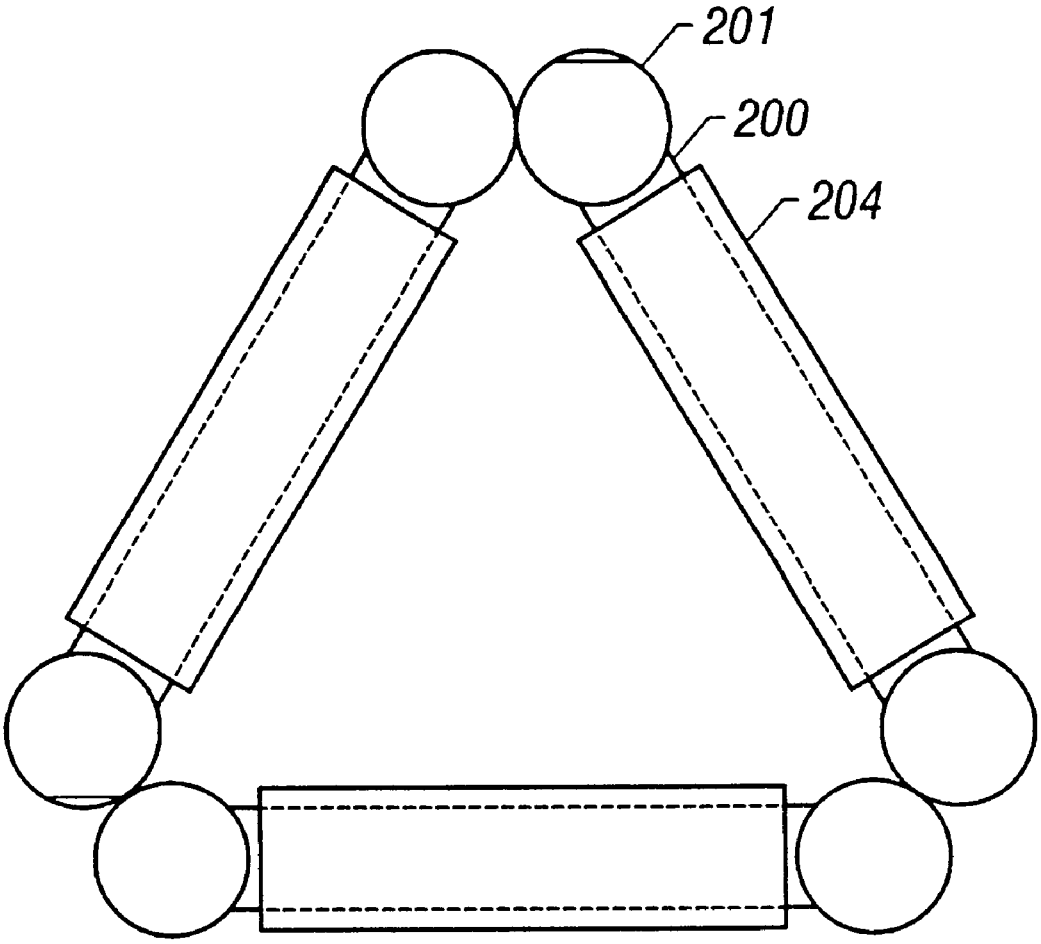
FIG. 1A is a side view of the basic meso-skeleton unit according to the present invention.

FIG. 1A shows the equilateral triangles used to create the meso-skeleton. They contain tubular members 200, a tubular sleeve 204 and sliding connecting means 200, 201 and 202.

Figure 8:
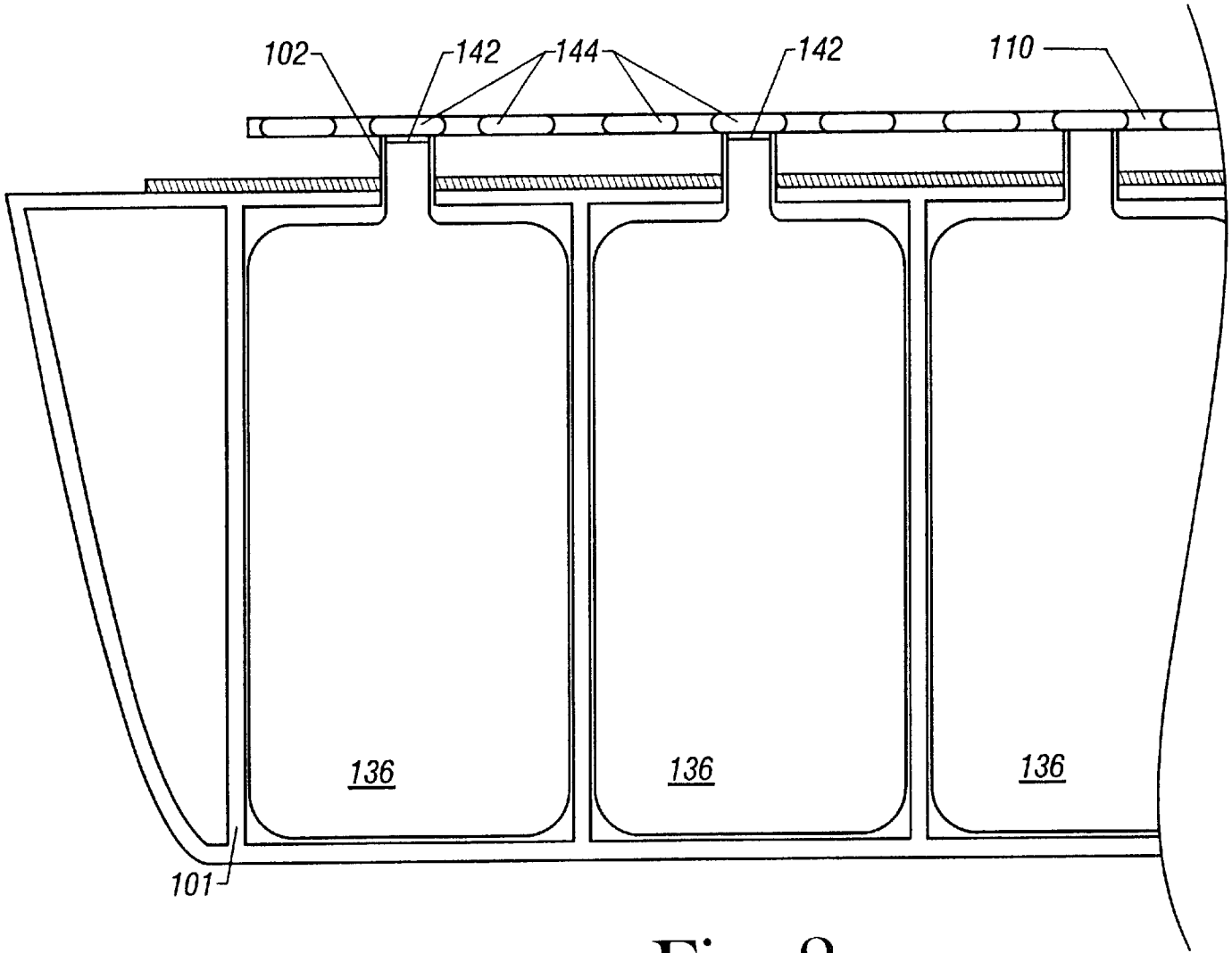
FIG. 8 is a side view of one embodiment of an offloading system according to the present invention.
Figure 9:
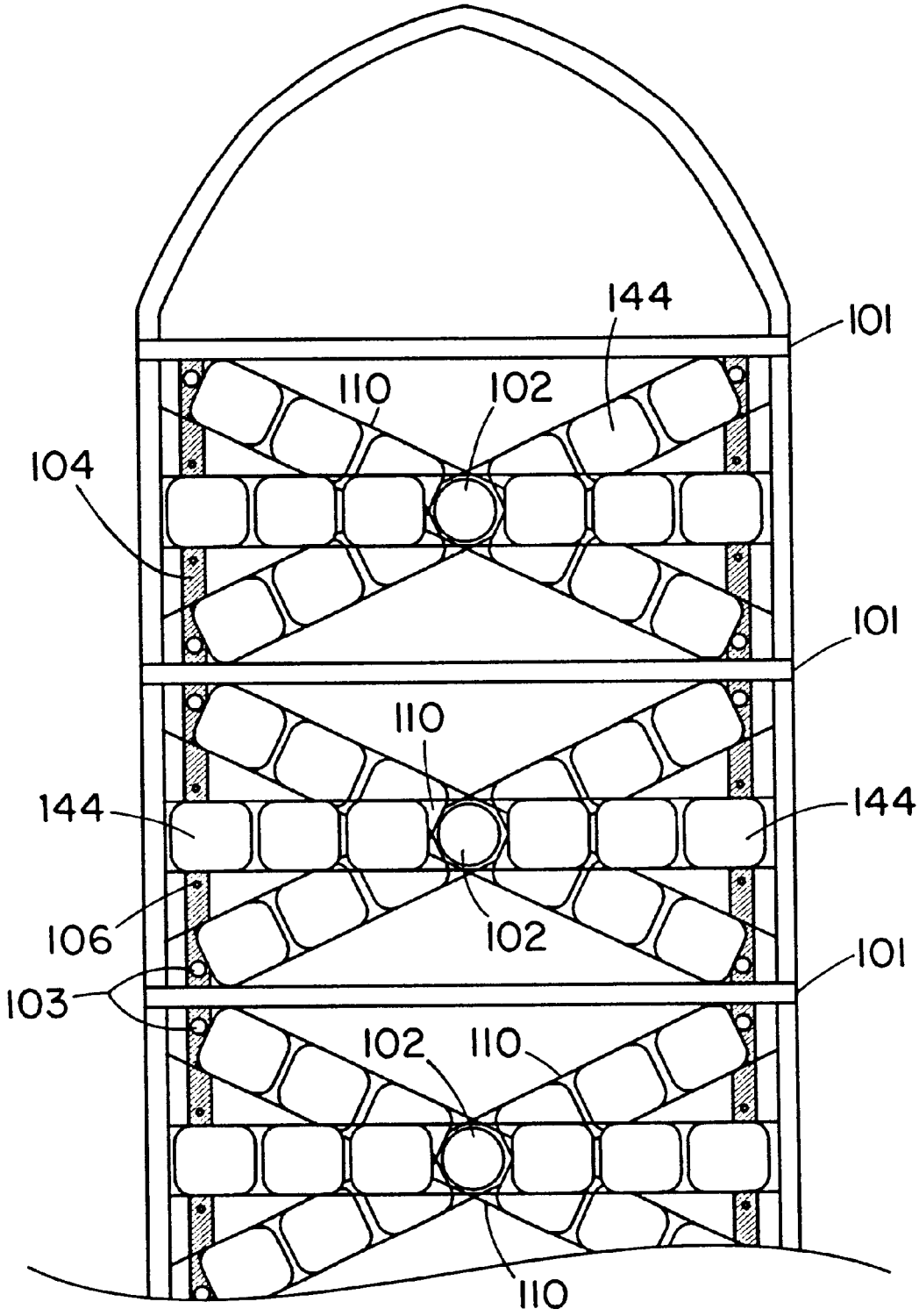
FIG. 9 is a top view of one embodiment according to the present invention of an off-loading system over a particular ship hold.
Figure 10:
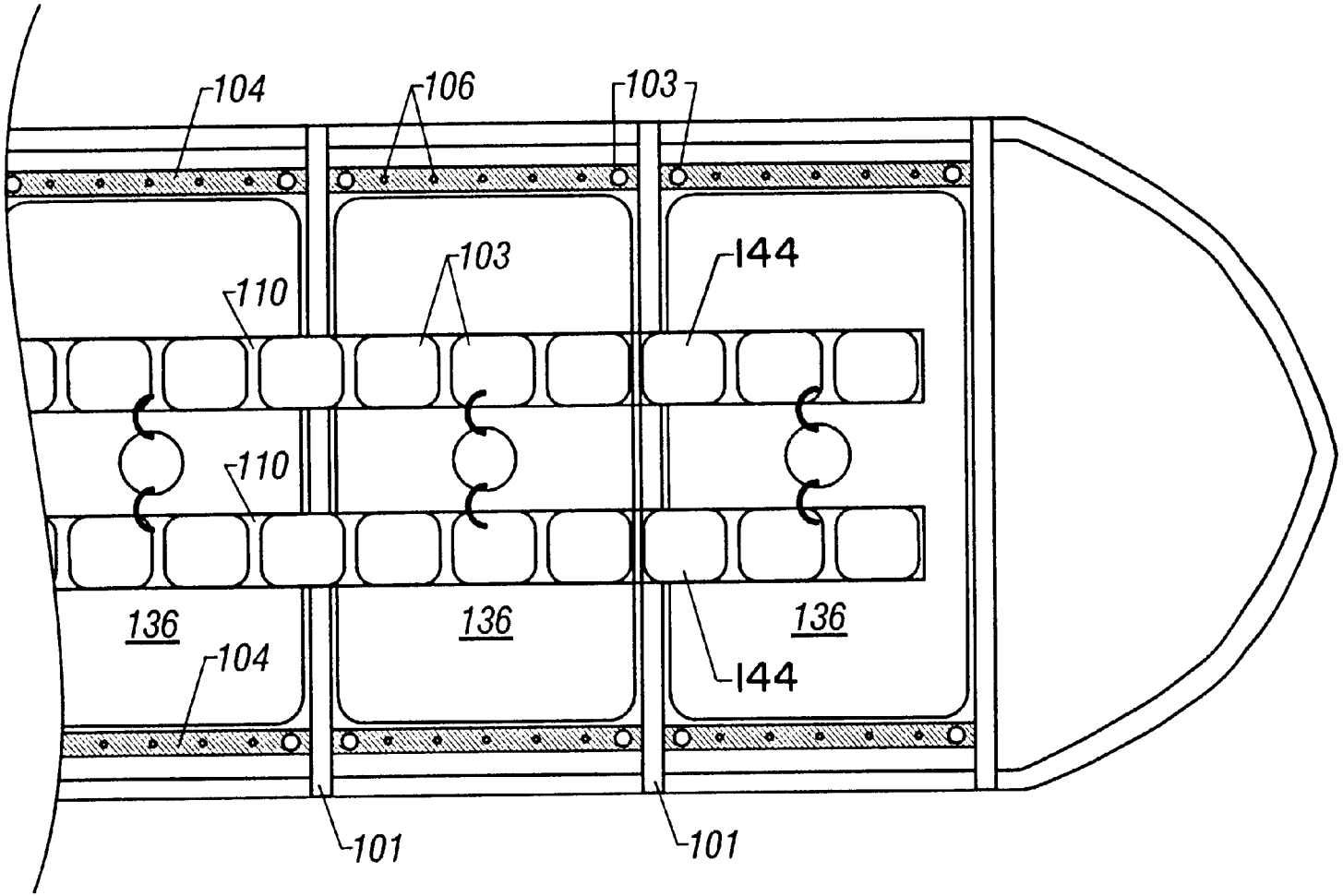
FIG. 10 is another embodiment according to the present invention of an off-loading system.
Figure 11:
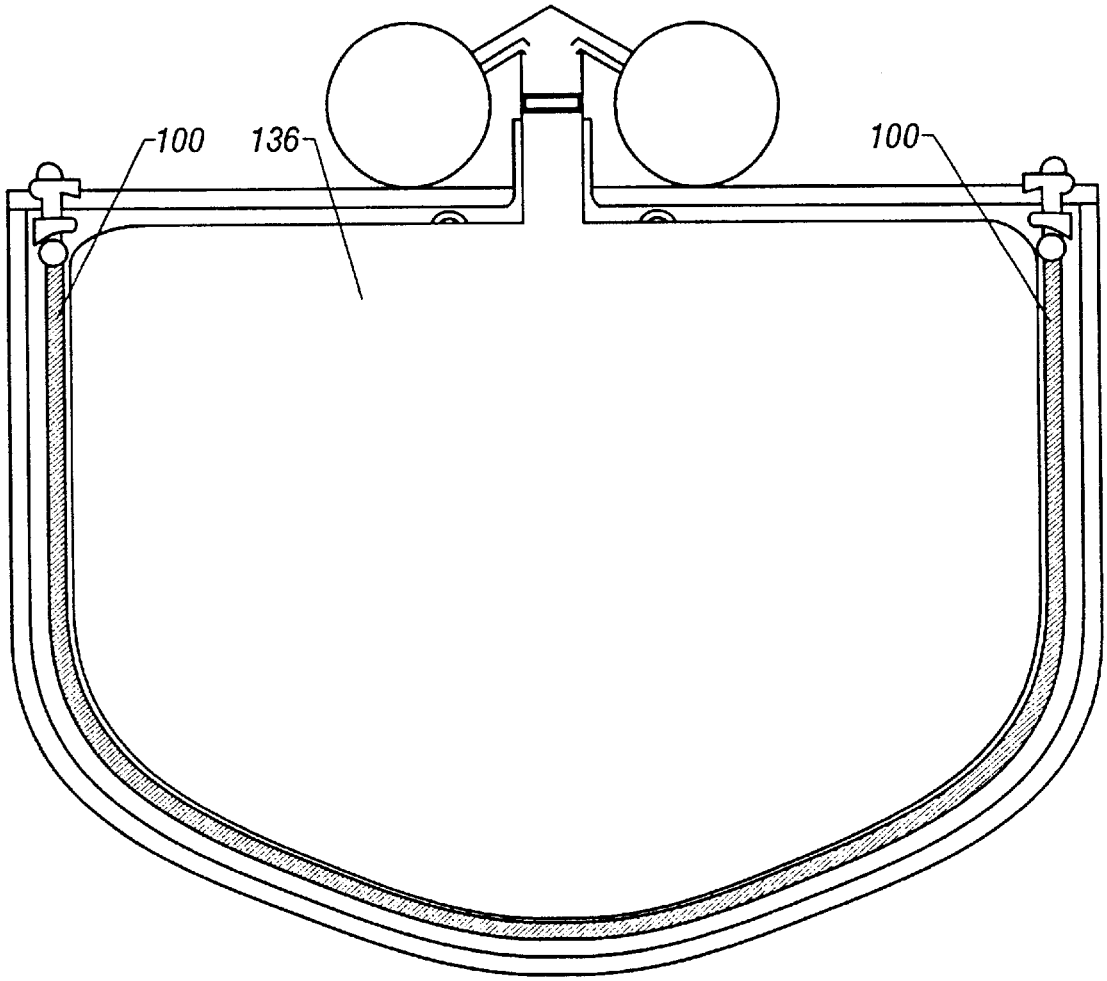
FIG. 11 is an end view of the ship with one embodiment according to the present invention of the off-loading system installed on the ship.

The Offloading Device is shown in FIGS. 8 through 11. Particularly in FIG. 8, are shown the compressed capsules 144 for receiving product. A six-way offloading device is depicted in FIG. 9 and a parallel offloading device is depicted in FIG. 8 and FIG. 10. The offloading troughs 110 which transport the loaded capsules 144 for storage or further deployment are shown in FIGS. 8 and 10.

The present invention relates to a method and apparatus for Hull breach containment system. The following is the detailed description of the invention.

Meso-skeleton elements:

Referring now to FIG. 1A in more detail, Meso-skeleton elements are apparatus according to one embodiment of the invention, that are equilateral triangles, preferably constructed from three tubular members 200 with an articulating condyle 201 on each end of tubular members 200. In this embodiment each tubular member would have an outer diameter ranging from 0.5 to 1.5 inch and preferably 0.75 inches outer diameter. In the most preferred embodiment, the tubular members could be solid. Each tubular member would have a joint or knuckle 202 (observed in FIG. 1B) capable of attaching to at least one or more tubular member providing movement in three planes; on three axes with up to 180 degree movement possible is the key element of the preferred embodiment.

The equilateral triangles are preferably stainless steel, and preferably solid, however, strong or reinforced hollow members can be used within the scope of this invention. The triangles could be made of legs that are tubular, rectangular, or octagonal in shape. Other shapes may be usable within the scope of the present invention, provided they can be jointed together with the unique tubular joints.

The preferable size of the meso-skeleton element is 1 foot length per leg in the preferred embodiment, but size could vary from being as short as 6 inches to as long as 18 inches. Longer or shorter legs may be used. However, such longer length legs would need to be constructed from graphite composite or ultra strong materials so that the meso-skeleton element (FIG. 1B) does not deform upon itself when pressure is applied to it as a functioning unit.

The tubular members of the meso-skeleton may additionally be covered in a tubular sleeve 204, preferably from a rolled sheet metal, preferably the same material as the tubular members, however, a coated sleeve, such as powder coated steel, or silicon, or elastomeric or polymeric lined material which would prevent corrosion of the tubular members and permit additional rolling of the tubular members against the unique bladder combination without tearing the tubular member and relieving the possibility of any adhesion of the tubular member against the bladder.

Optionally, the meso-skeleton elements could be construed of solid triangular materials or otherwise that have strong supporting sides. The solid element could be a fabric, which would cover the side structural elements and provide further cushioning against the bladder. The cover for the bladder could for example, be fabricated from leather, cloth, plastic or other flexible materials. As a specific example, the cover could be fabricated from the KEVLAR product manufactured by or on behalf of I.E. duPont de Nemours and Company of Wilmington, Del. KEVLAR is the trademark of Dupont. The KEVLAR material is a flexible, synthetic fiber of high tensile strength which has been used to make bullet proof vests among other things. Suffice it to say at this point that the function served by the cover which is formed by the meso-skeleton elements of this present invention could also be performed by various other materials to allow intruding objects such as another boat hull to push against the cover and hence against the bladder to perform the various objects of this present invention.

Meso-skeleton Element Joints

The legs of the triangles are connected together with rotatable joints 202, similar to a knuckle type joint, permitting multi-axis rotation of three connections as well as translation of force from each leg through the joint.

Skeleton Strips

Meso-skeleton elements are prejoined into skeleton strips. In the preferred embodiment, the strips are created to either be one, two, three or more meso-skeleton elements wide (as in FIG. 4) strips which can be anywhere from 5 elements up to 150 elements or more in length.

The strips are attached at one end to a deck hull hanging device (FIGS. 1, 2, 3, 4, 5, 7, 8, 9, 10, and 11) and then the strips are connected together by tack welding 134, and fitted against the side of the interior of the hull.

Figure 1B:
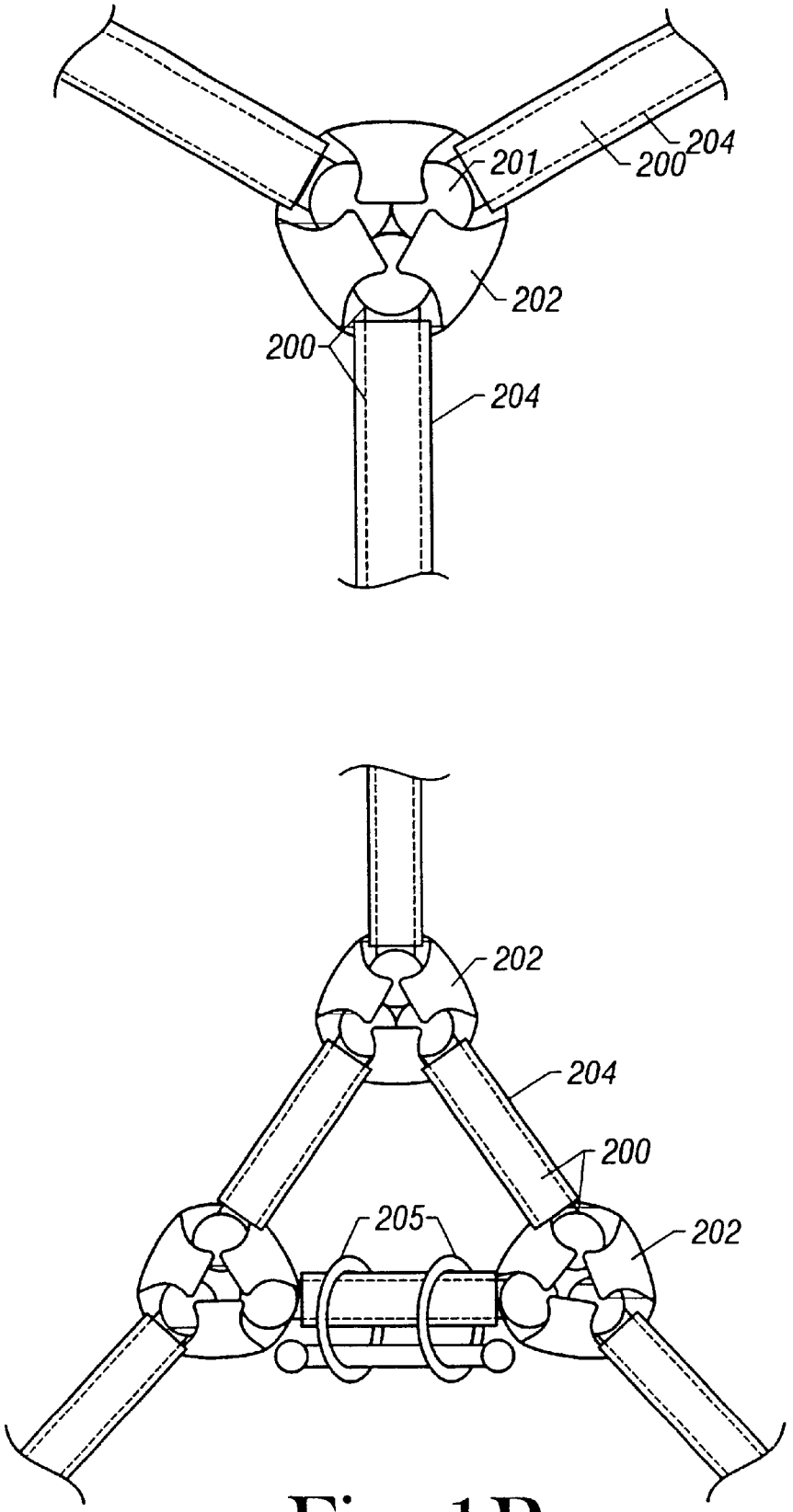
FIG. 1B contains two views of the knuckle device according to the present invention that joins the meso-skeleton together.

The meso-skeleton strips can be connected together by placing a connecting sleeve 205 FIG. 1B around the sleeved tubular member of adjoining skeleton strips thereby containing two sleeved tubular members on one connecting sleeve. The connecting sleeve could be a hinged device capable of clamping over the sleeves for easy installation in the field.

Deck Hull Hanging Device

The deck hull-hanging device comprises a series of flat rectangular plates 104 that extend from the bow of the ship to the stern, and each plate specifically extends from the edge of one bulkhead in the hold of the ship to the edge of the next bulkhead in the hold of the ship. The plates are placed as close as possible to the edge of the ship's hull-deck interface. The plates extend from bow to stem on each side of the ship, both the starboard side and the port side. It is even contemplated that this device could be used to extend across the stem of the ship as well and provide protection on all exposed sides of the vessel. It is possible that the plates could be stopped prior to meeting at the bow, as the bow compartment typically does not hold cargo such as oil or similar materials.

The plates are bolted, riveted or welded to the superstructure of the deck, so that the deck hull-hanging device maximizes the support of the plates while connected to the meso-skeleton.

A main hanging support rod 105 is placed under the deck in the hold and in line with the plates that are on the deck. The rod is connected to each plate via a bolt which extends from the rod through the deck, through the plate and is bolted, welded or riveted to the plates. If the plates do not extend the full length of the ship, it is contemplated that two rods would be used within the scope of the present invention within each cargo compartment of the hold. The deck plates that support the hanging support rod are intended to provide weight transfer or load transfer in the vertical plane.

A support strut 134 (FIGS. 2, 3, 4, and 11) for connecting the rod to the interior hull of the ship is used in the preferred embodiment so as to provide weight transfer or load transfer laterally which impact the rod due to stresses on the meso-skeleton. Depending on the weight of the meso-skeleton, it may be possible to not use the support strut and only use the deck plates to support the rod holding the meso-skeleton. At least two support struts per rod are contemplated, but additional support struts can be used depending on the size of the hold of the ship. Preferably, each time the rod is connected to the deck, a support strut should be used against the interior hull of the vessel.

The support strut can be welded to the hull, rivets or otherwise connected to the interior hull of the ship.

Sliding connecting means 205 FIG. 1B, such as a stainless steel loop or a coated metal loop, or similar slidable mechanism can be used to hold the meso-skeleton onto the rod. The sliding connecting means attaches to the meso-skeleton by fitting over the tubular sleeve of the meso-skeleton element that is parallel to the rod.

Bladder 136

A bladder (FIG. 5) having a neck and at least one bladder support means is used with this invention. The bladder is preferably made of a strong material, such as rubber, KEVLAR, PEEK, PFTE or a similar super strong flexible, fabric-like material. Teflon-coated nylons or other coated polymeric materials may be usable within the scope of the present invention if they are strong, resistant to both salt water and hydrocarbon degradation and other chemical corrosion. Woven and non-woven materials may be usable within the scope of the present invention.

The bladder is preferably custom designed in size to exactly match the size dimensions of the ship hold into which it is to reside. The bladder is designed so that it is contained laterally and interiorly by the meso-skeleton structure. The bladder is lowered through a deck port into the hold and then partially inflated so that the bladder lies against the meso-skeleton which has already been inserted in the hull of the ship. Cargo, such as oil, water, fertilizer, grain, or other fluids, including wine or beer, could be then flowed into the bladder through a conventional fill and discharge port, preferably, located on the top surface of the bladder. Remaining air is then evacuated form within the bladder to provide a bladder containing only cargo. The bladder is then sealed such as with a pressure sensitive valve 142 that is capable of monitoring and maintaining the pressure on the cargo at the predetermined setting. The bladder is preferably shaped much like a balloon. The thickness of the bladder material preferably runs from 0.25 inches in thickness to approximately 1 inch in thickness. The bladder may be made of one single material or could be laminate structure. The bladder materials need to be flexible and capable of sustaining high tensile strengths anticipated in a hull breach condition.

Preferably the bladder material is nonflammable or at least flame resistant.

The bladder is preferably designed with a support means 140 that can be used to lift the bladder into and out of the hold of the ship. The support means is preferably attached to at least one side of the bladder and is strong enough to support an empty bladder during installation or removal.

A pressure sensitive valve 142 preferably conventional a one-way check valve which allows fluid to flow only out of the bladder located in the port which permits cargo to exit the bladder through the neck of the bladder. This pressure sensitive valve is contemplated to be a pressure sensing and monitoring device to monitor the pressure on the cargo in the bladder as well as a valve which can be automatically opened if pressure of the cargo reaches a certain set value or can be manually operated, depending on the needs of the ship's crew. This pressure sensitive valve is directly connected to the offloading device.

In the most preferred embodiment, it is contemplated that the pressure sensitive valve would be designed to operate in a "fail-safe" mode, and that it could open to offload cargo into the Offloading Device should the crew be unable or unwilling to open the valve when pressure on the cargo in the bladder reached certain critical limits.

Offloading Device

In this invention, if the meso-skeleton structure is installed, the bladder is in place and the cargo or product is placed in the bladder and if the hull of the ship is breached, the following steps in accordance with the present invention occur to prevent cargo contamination into the sea surrounding the ship. First, a deformation of the hull occurs inwardly because of the hull breach. The meso-skeleton is moved, applying pressure uniformly on the bladder. The sensor in the neck of the bladder detects a change in pressure on the bladder contents and opens the valve. Cargo moves through the valve and is distributed into at least one offloading tube. In the preferred embodiment, six offloading tubes are contemplated for use with each ship hold that is contained by bulkheads.

In each offloading tube, are compressed capsules that have at one end, a flapper valve for receiving cargo. Cargo is moved into the capsules, the capsules expand to fill capacity and are then either stored on the deck of the ship or launched into the water into a tethered containment device, such as fisherman's netting supported by buoys, or other floatation devices which would keep the cargo afloat. Assuming the oil or other transported cargo has a lower specific gravity than water, the cargo will float on top of the water in its capsules. The tethered containment device can be tied to the ship, or tethered to a remotely operated vehicle to move the cargo in the now expanded capsules away from the ship so as to prevent damage to the containment devices from the ship itself or from the hazard that caused the hull breach. In one embodiment, the offloading system can comprise one or more troughs designed to receive and convey the compressed capsules. The once filled capsules would continue through the trough system to a platform which would be launched onto the water's surface. The launch could either be tethered to the ship or be moved by remote operation away from the ship or area of potential hazard to the contained material. Once enough cargo is removed to equalize pressure in the hold, the pressure sensitive valve closes and thereby reestablishes containment of the remaining cargo in the bladder in the hold. Should water flow into the hold due to the hull breach, that water can enter the hold without contaminating the cargo in the bladder to enable the ship to somewhat stabilize in that compartment.

The invention is illustrated with reference to a specific embodiment; however, modifications of the embodiment are contemplated, for example, as in accord with the following even more preferred embodiment.

The embodiment of FIGS. 12–20 is comprised of the following components:

(a) Customized bladders that will be installed into each oil tank. They will be formed to fit the internal tank structure and be flexible enough to deform without rupture in the event of a grounding or collision.

(b) Meso-skeleton system that will surround and passively support the bladders in each cargo tank independently, protect the bladders from rupture, and deform superficially with the bladders. The meso-skeleton will wrap around internal tank structure as needed, but is not attached other than at the main deck.

(c) Oil overflow containment system deployed on the tanker deck that will contain the oil flowing out of the bladders in case of deformation of the cargo tank boundary due to grounding or collision.

The system according to the invention is generally intended to work in the event of an accident as follows: During a collision or grounding of sufficient magnitude, the tanker's double hull or double bottom is ruptured. As a result of this hull penetration, the bladder and meso-skeleton deform as necessary, with the meso-skeleton providing a flexible yet protective barrier that prevents damage to the bladder itself. The volume of oil displaced by this penetration does not, therefore, flow out of the hull breach, but is instead squeezed out of the bladder through a neck at the top of the tank and into a large diameter header pipe above the main deck. If similar damage occurs to other cargo tanks, additional oil is forced from the respective bladders into the header pipe. If the resulting volume of displaced oil exceeds the volume of the header pipe itself, then a series of expandable bags which are attached to the header pipe will be filled as needed. Once filled, these bags can then be launched overboard until they can be safely retrieved.

The description of each component of the system is provided in the following paragraphs.

Figure 12A:
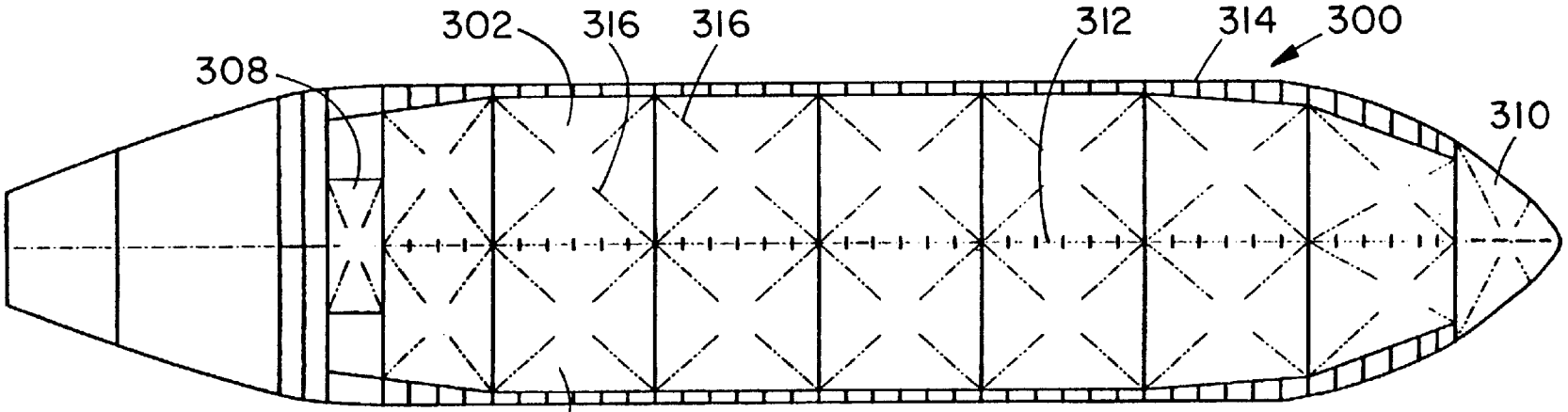
FIG. 12A is a conventional double-hull tanker which can be fitted with an apparatus in accordance with the present invention.
Figure 12B:
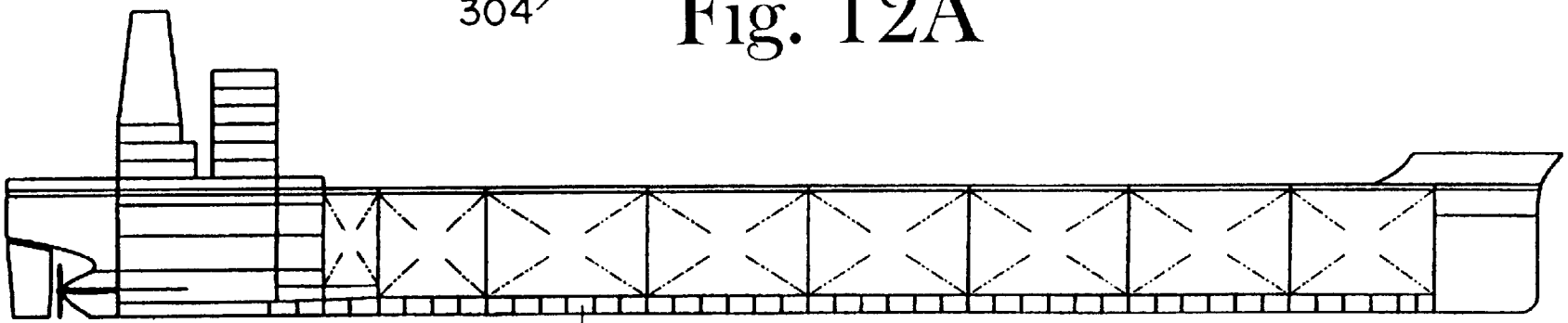
FIG. 12B is a top plan view of the tanker illustrated in FIG. 12A.

The baseline ship 300 used to describe the system is a typical 125,000 DWT double hull tanker. A sketch of this tanker is shown in FIGS. 12(A) and (B). The ship 300 has two cargo tanks 302 and 304 across and has a double hulled construction in accordance with OPA '90. The width between hulls is 6'-8" (2M), while the double bottom 306 is 9'-10" (3M) in height. This ship 300 has been selected for this installation of the system according to this invention because it is representative of tankers in the Alaska to California trade. This trading route runs along one of the most environmentally sensitive coastal areas of the United States.

Figure 13:
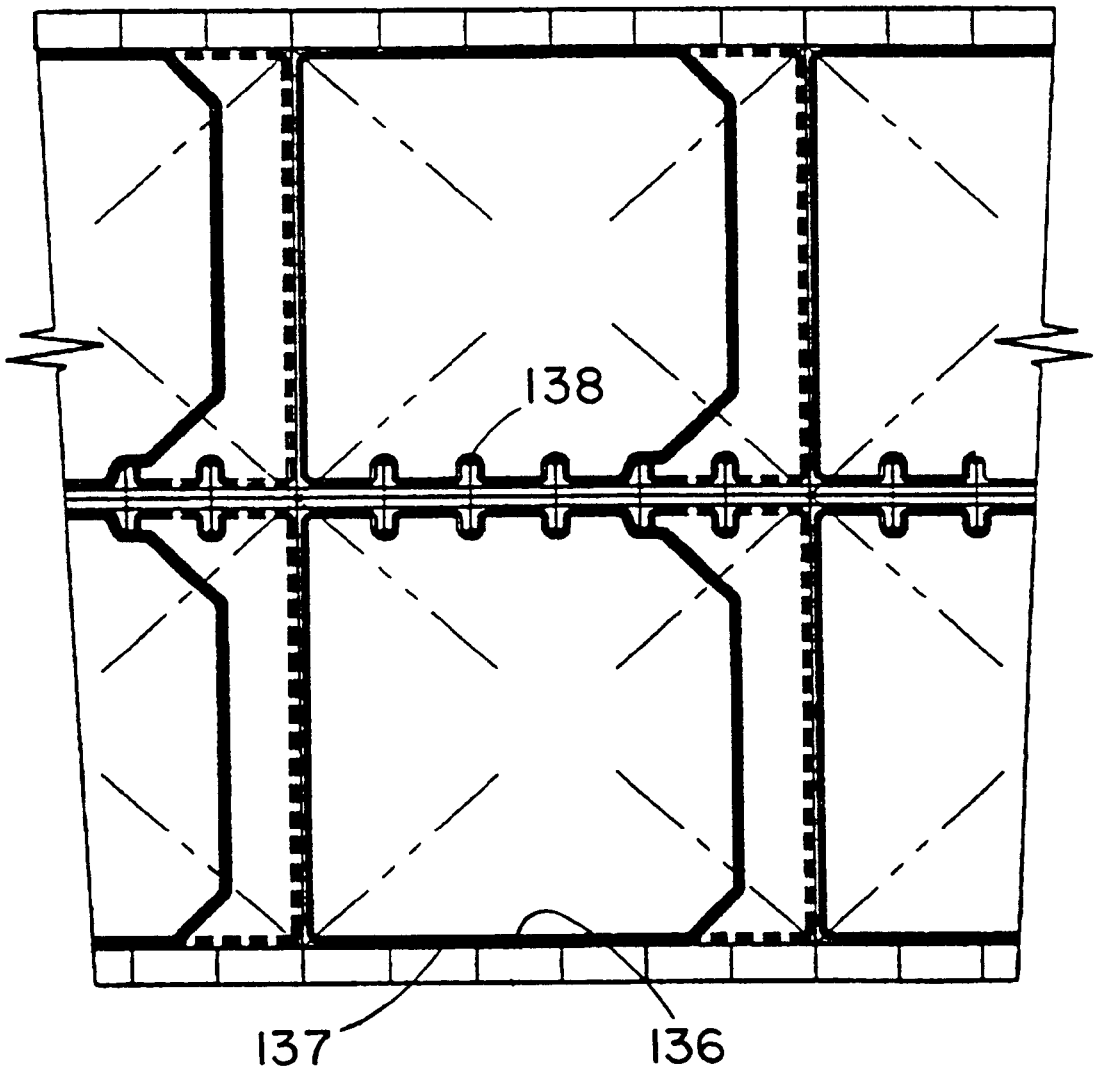
FIGS. 13, 14 and 15 illustrate a plan view, transverse section, and an inboard view of the tanker illustrated in FIGS. 12A and 12B, respectively, with the apparatus in accordance with the present invention installed inside the cargo tanks illustrated in FIGS. 12A and 12B.
Figure 14:
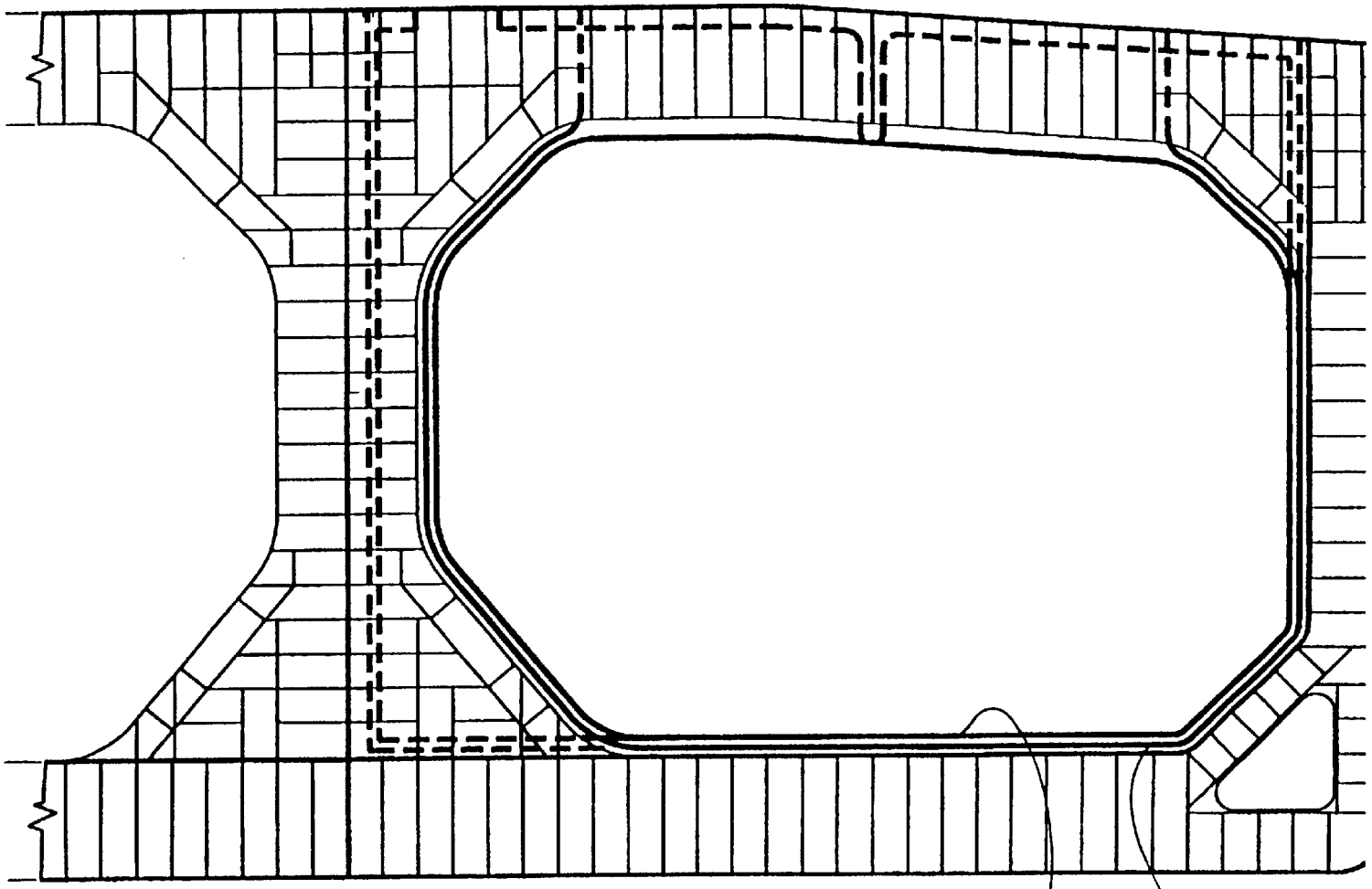
Figure 15B:
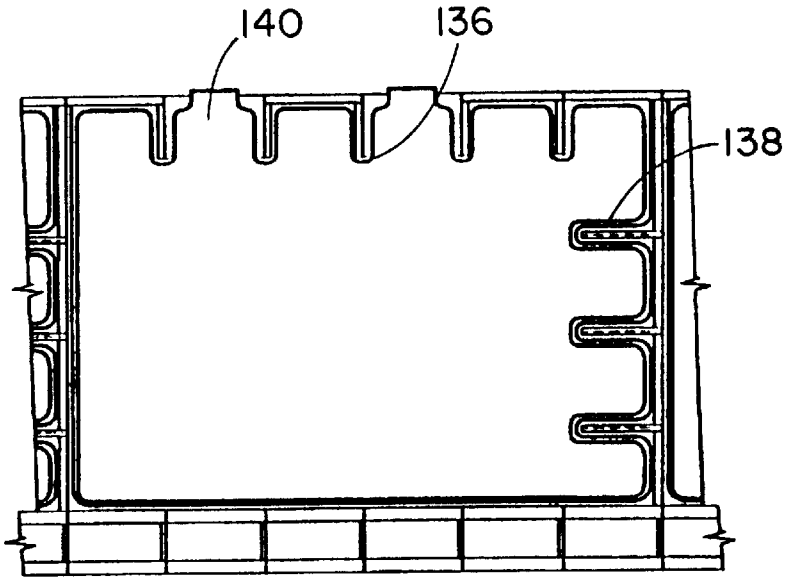
Figure 15A:
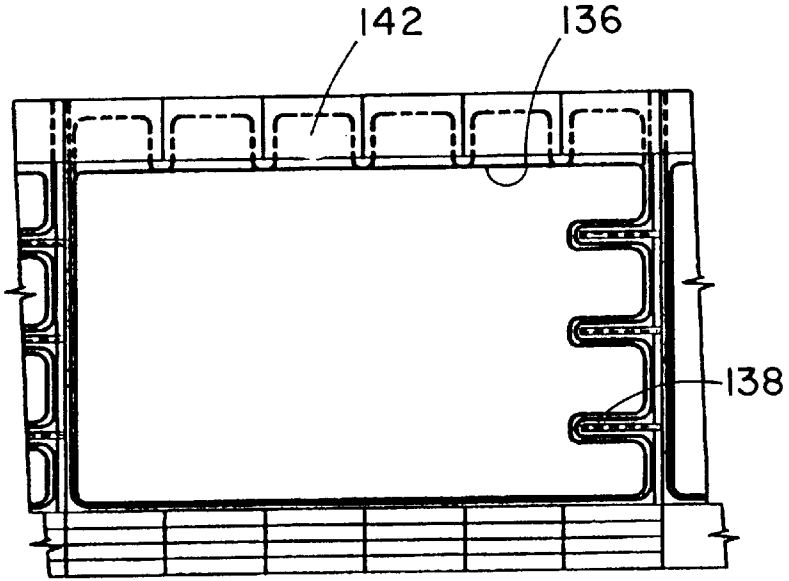

The tanker 300 utilized for the system description is a conventional, longitudinally framed tanker. The cargo tanks are bounded fore and aft by transverse bulkheads 308 and 310 and on the sides by the centerline longitudinal bulkhead 312 (inboard) and the ship's double hull 314 (outboard). Transverse web frames 316 are spaced 15' apart. The outboard bulkhead, after bulkhead, and tank bottom are essentially smooth plates (stiffening outside) for each tank. FIGS. 13, 14 and 15 provide a plan view, a transverse section, and an inboard view of the tanker, respectively, with the bladder and meso-skeleton inside each cargo tank represented by the heavy lines in each sketch.

Figure 16:
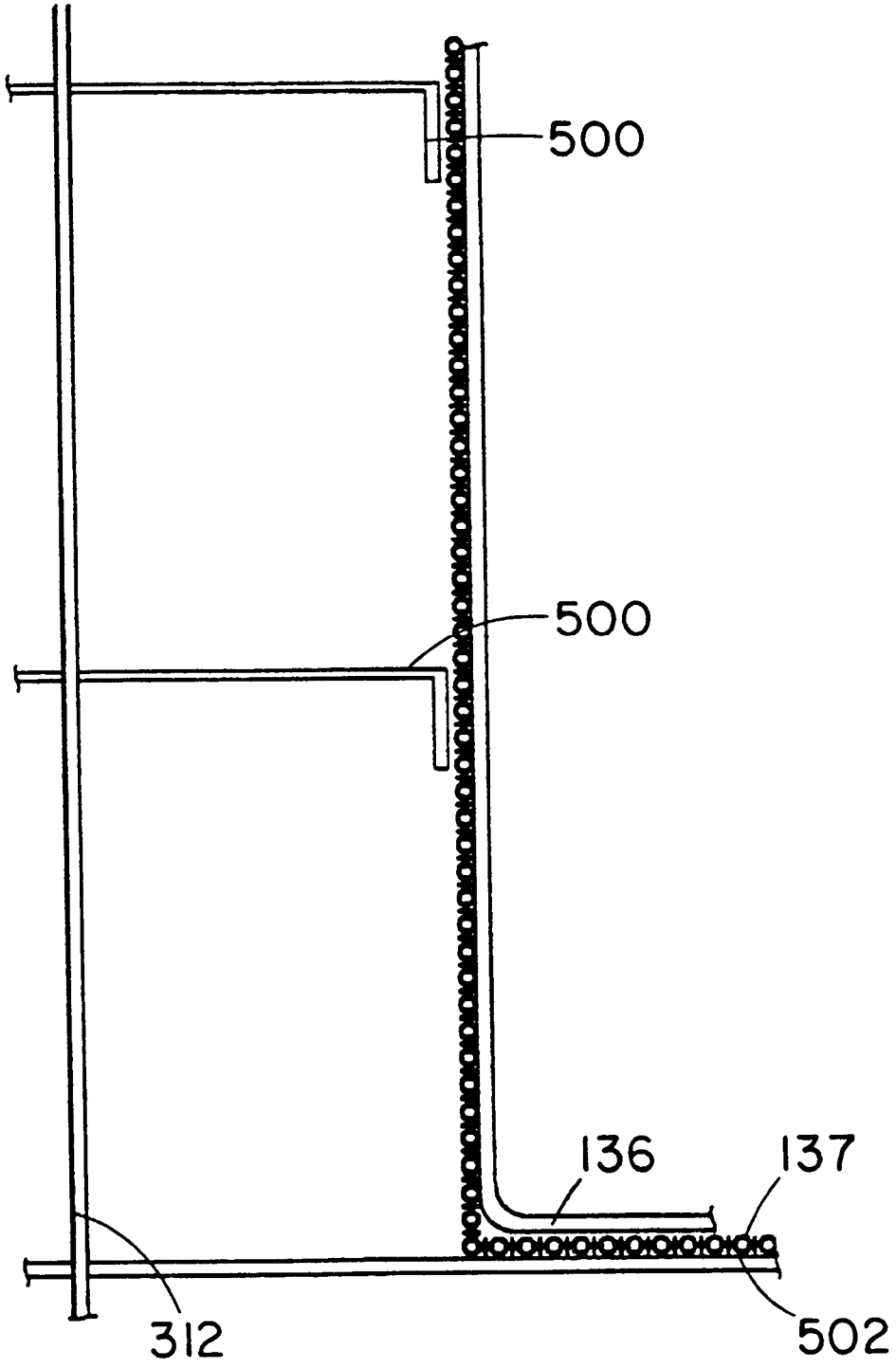
FIG. 16 illustrates a stiffener used to form structure within the apparatus in accordance with the present invention.
Figure 18A:
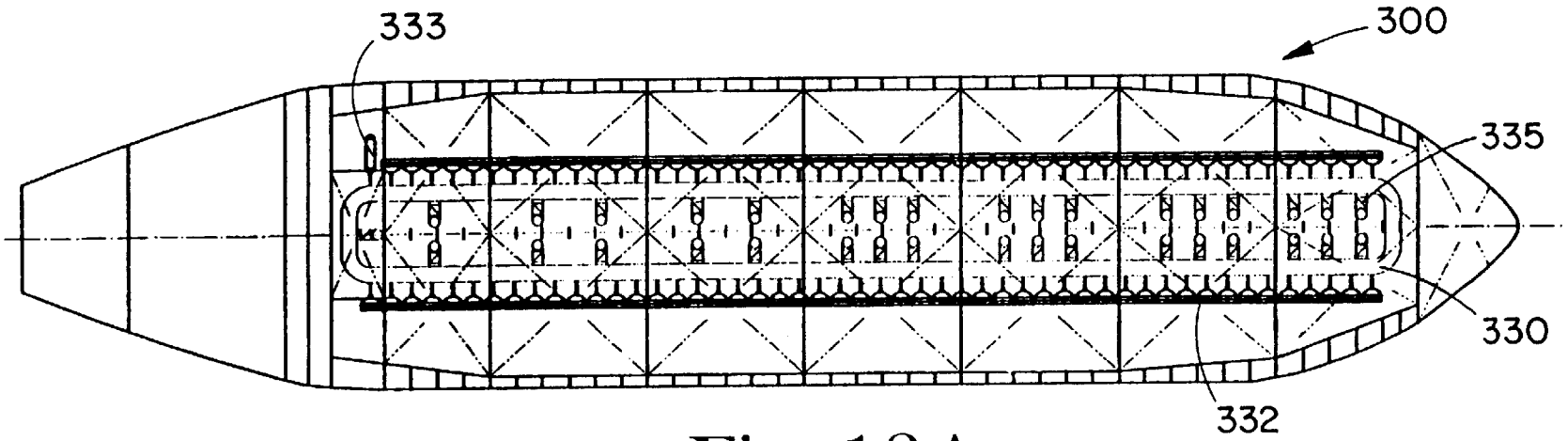
FIGS. 18 (*a*) and (*b*) further shows the ship illustrated in FIGS. 12A and 12B and including the apparatus in accordance with the present invention installed therein.

The bladder and meso-skeleton system will wrap around the large stiffeners (i.e., web frames and horizontal stringers 138) as shown in FIGS. 13, 14 and 15, but not around the numerous smaller stiffeners—as shown in FIG. 16—for practical considerations. In FIG. 16, the L-shape bulkhead stiffener 500 is used in conjunction with the inner bottom 502 and the centerline bulkhead 312 to provide stability to the meso-skeleton 137 and the bladder 136. FIG. 18 shows the arrangement of the oil overflow containment system according to the present invention.

System Components

The purpose of the bladder system is to contain the oil from each tank in the event the tank boundary is pierced by either grounding or collision. Each bladder will be made of a flexible material, preferably fabricated from rubber, or other elastomeric material, or plastic or fiber, or combinations thereof, that can be custom designed to fit into, and conform to the internal contours of, each tank. The interchangeability of bladders would allow for replacement according to changes in cargo types. Each bladder will have one or more necks at the top of the tank to permit oil to flow out of the bladder and into the header pipe quickly in the event of an accident. Seawater entering the tank through a hull breach will, for the most part, remain isolated from the remaining oil by the bladder.

The bladder is required to be:

1. deformable
2. Very large (capacity approximately equal to that of tank itself) and able to conform to tank boundaries
3. Fitted with necked opening(s) at the top
4. Resistant to saltwater, hydrocarbon degradation and other chemical corrosion 5. Able to withstand a given head pressure, for example, 30 psi head pressure
6. Installable and removable through a hinged access in the main deck
7. Long-lasting Meso-Skeleton The purpose of the meso-skeleton 137, illustrated in detail in FIG. 17, is to provide the bladders of a tanker with the necessary protection in the event of various types of potential collisions. For any given tank, the meso-skeleton will provide protection along the four-bulkhead perimeter of the tank as well as along the tank's innerbottom. The portions of the meso-skeleton along each bulkhead will be supported from structural supports installed near the main deck level.

The meso-skeleton is required to be:

8. Deformable
9. Able to prevent damage to bladder
10. Able to support pressure from the bladder under normal conditions and in the event of a collision
11. Able to resist saltwater and other chemical corrosion
12. As lightweight as possible
13. Able to be supported along the sides by main deck. Similar supports should exist on each side of the transverse bulkheads.

Several meso-skeleton configurations were investigated using chain links and a combination of chain links and small rounded plates. Chain links were investigated because they allow rotation in three directions, which is needed to help the meso-skeleton deform easily and prevent rupture of the bladder. The preferred configuration is discussed herein below.

Oil Overflow Containment System

The purpose of the oil overflow containment system is to collect oil that has been evacuated from the bladder system after the inner hull of the tanker has been deformed inward by grounding or a collision. The major components of this system include:

1) Overflow pipes connected to the bladders' necks 140 on one end and to the header pipe on the other end.
2) A large diameter header pipe 330 deployed on the main deck of the tanker.
3) Multiple iridescent, expandable bags 332 located along the header pipe 330 with a conventional radio beacon/strobe (not illustrated) attached to each for ease of location. Oil evacuated from the bladder(s) in the event of an accident will be contained within the bags 332, which can be, in turn, maintained within the tanker, or deployed and launched into the water for later retrieval.

Figure 18B:
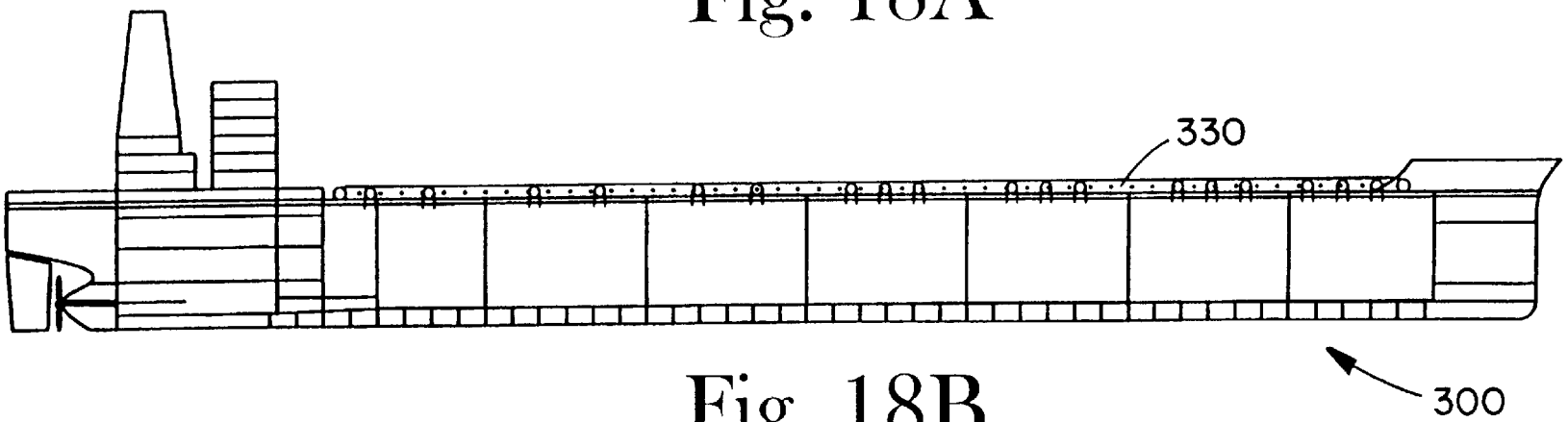

A sketch of the oil overflow containment system is presented in FIG. 18. Overflow pipes 335 will be provided 1, 2, or 3 per tank, depending on the size of the tank and the anticipated rate of oil evacuation. Overflow pipes will be provided with check valves to prevent cargo shifting between tanks in rough seas. The expandable bags 332 will be provided with gate valves 334 and quick disconnecting devices so they can self-disconnect when full. One such bag 333 is illustrated in FIG. 18B as being filled.

System Operation and Concept Calculations

In the unfortunate event of a tanker running aground or colliding with another ship, the system is intended to prevent an outflow of oil into the water even if a double hull tank boundary has been breached. During such an event, either the tank's innerbottom or a tank bulkhead is assumed to deform inward and compress the tank's meso-skeleton and bladder. The meso-skeleton is intended to provide a shielding effect for the bladder that will prevent it from being ruptured even as it's compressed. This compression at the time of the accident forces a volume of oil out of the affected bladder through openings at the top of the tank. The volume of this displaced oil is proportional to the extent of the inner hull penetration. The oil removed from the bladder system is then collected by the oil overflow containment system.

Meso-skeleton Concept Calculations

The most promising meso-skeleton configuration of those investigated is show in FIG. 17. It was the lightest in weight while still providing the strength necessary to withstand the design head pressures. It consists of a series of rounded steel plates 400 that are joined together via detachable steel chain links 402. This configuration permits the meso-skeleton to deform when needed during a collision, as well as to conveniently form itself around the major structural stiffening members of the tank (i.e., web frames and horizontal bulkhead stringers 138).

Preliminary calculations were made to size the meso-skeleton system components to provide analysis of the system. Two basic cases were considered in the analysis:

Determination of the meso-skeleton's ability to withstand the normal operating hydrostatic pressure of the bladder pushing against the meso-skeleton in between bulkhead stiffeners at the bottom of a tank.

Determination of the meso-skeleton's ability to support the bladder in the event of a grounding collision which leaves a long opening in the innerbottom structure that must be spanned by the meso-skeleton.

Assuming the use of stainless steel (CRES 316 alloy) for corrosion resistance (galvanized mild steel may also be used provided its yield strength equals or exceeds the 32 ksi of CRES 316), it was found that at least ½" (0.52" diameter) chain links 402 are required to satisfy both scenarios. See FIG. 17 for details of the links and plates.

Oil Overflow Collection Concept Calculations

Figure 19:
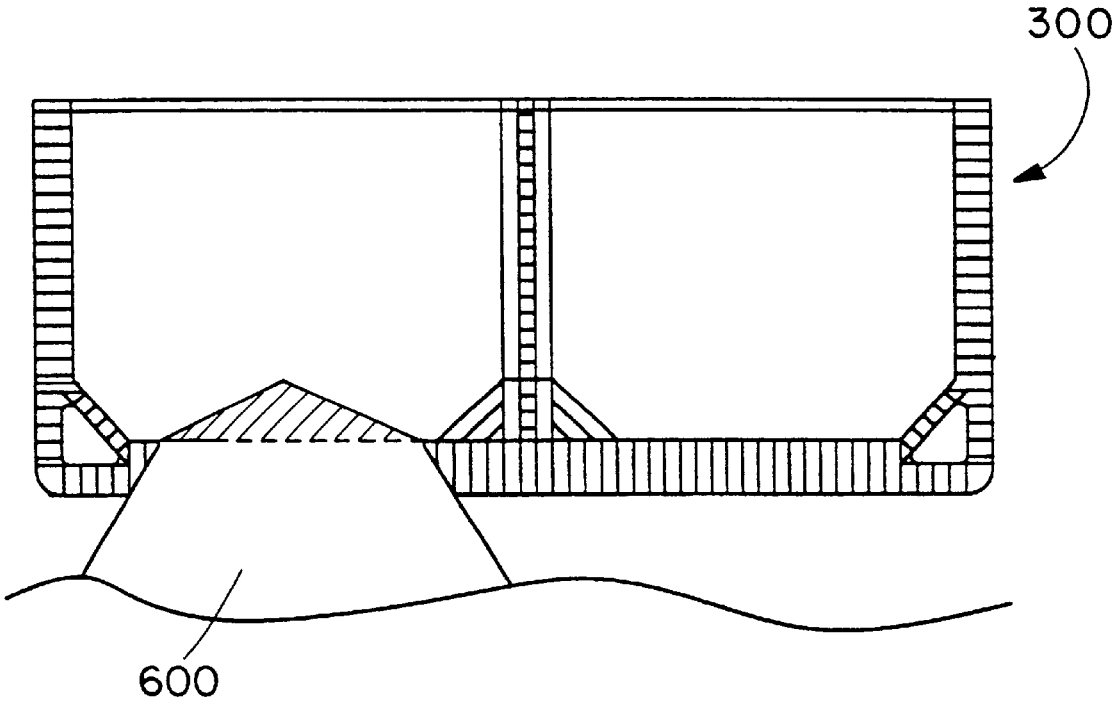
FIG. 19 illustrates in a diagrammatic manner the effect of grounding a ship upon the bottom of the water through which the ship is traveling.
Figure 20:
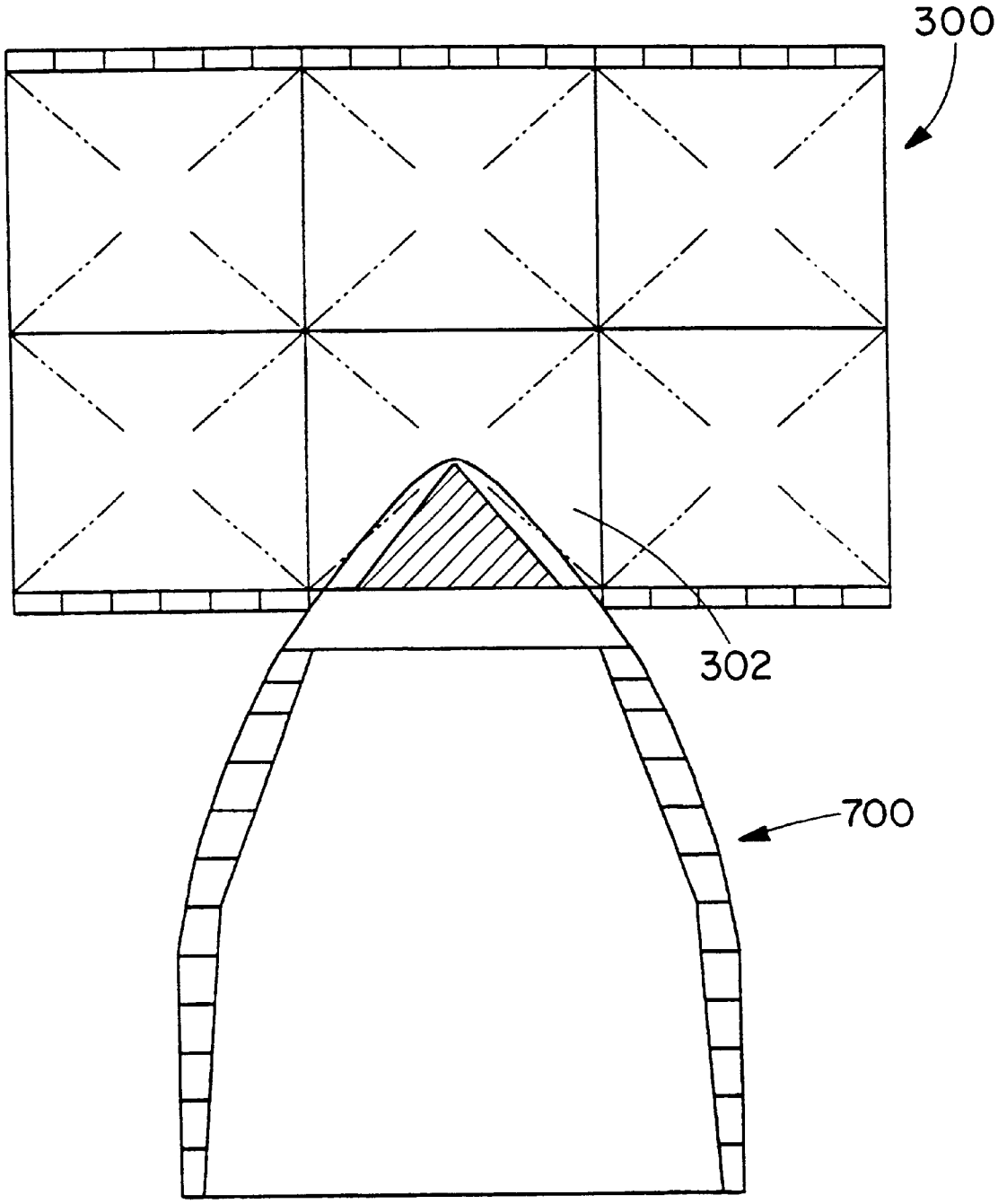
FIG. 20 illustrates the effect of a side collision between the tanker illustrated in FIGS. 12 (A) and (B) and another sea-going vessel.

The responses of the oil overflow containment system were investigated for two different types of accidents: (1) grounding; and (2) side collision. These two different types of tanker accidents are illustrated in FIGS. 19 and 20, respectively. The responses of the oil overflow containment system to these accidents are discussed herein below.

System Response to Tanker Grounding

It was assumed that all tanks on one side of the tanker, either port or starboard, are subjected to raking damage from a pinnacle rock 600 that penetrates 20' into the ship from the bottom of the keel. As the ship progresses forward, this rock tears through successive tanks. This represents a major grounding event that, without recovery provided by the system, could potentially result in a substantial oil spill. The following assumptions were made:

5 percent of all tanks' volume on one side of the ship is forced out of the meso-skeleton and bladder system. This oil will be displaced upward and flow through the overflow pipes to the header pipe and then to the expandable bags illustrated in FIG. 18.

The ship's initial speed was 15 knots.

The ship is fully loaded at zero trim.

The ship will come to rest approximately 1500 feet after initially hitting the rock.

As the ship's velocity steadily decreases during the impact, the impact time for each affected tank was calculated. The pinnacle of rock impacts each successive tank for longer times as the ship slows down.

The following is a summary of the analysis:

1) Header pipe diameter will be about 9 feet
2) Overflow pipe diameter will be about 6 feet
3) Most tanks will require multiple overflow pipes due to the short impact time.
4) One hundred expandable bags, each about 17 feet in length and weighing about 8 tons when full, will be required, or
5) Twenty-eight expandable bags, each about 73 feet long and weighing about 30 tons when full, will be required to recover the oil flowing out of the bladders.
6) Each expandable bag will be filled through a 1-foot diameter pipe.

The expandable bags can be released overboard after being filled. These bags will float because the specific gravity of oil is less than that of seawater. They will be recovered from the sea by a lightering ship by means of a crane or netted and towed by a tugboat to shore.

System Response to Tanker Side Collision

This type of accident is the most demanding on the oil overflow containment system. FIG. 20 shows the type of side collision that was investigated. It shows a ship 700 of about the same size as the baseline tanker striking and penetrating the inner hull of one tank 302. This represents the most severe type of side collision terms of the rate of oil evacuation from the tank. Due to the speed of the impact for the affected tank, a large quantity of oil must be transferred from the tank and into the oil overflow containment system in a very small amount of time. In attempting to accommodate the most severe of potential collisions, the flow rate of oil out of the bladder became somewhat high for containment purposes. Therefore, there was calculated the maximum acceptable severity of a side impact collision, given the system that survives a grounding accident. The supporting calculations indicate that the system can take a side collision resulting in 7 percent overflow of one tank, as shown in FIG. 20, with an impact time of 6 seconds. Side collisions that result in larger overflows or shorter impact times require the bladder to have more overflow pipes to accommodate the high flow rate of oil leaving the bladder. The side collision that the oil overflow system can withstand (7% overflow in 6 seconds) is nevertheless a severe collision. If more than one tank is penetrated because the striking ship collides with the tanker at a different angle, rather than perpendicular to the ship, or if it collides with the tanker at a different longitudinal location, then the oil outflow per tank would be less and the system would be able to handle the overflow.

Impacts on Existing Tanker Design

Incorporation of the system according to the invention on existing double hull tankers will impact the design and operation of these ships in several ways. The major system impacts are described below.

Cargo Oil Piping System—Cargo fill, drain, and stripping systems will need to be modified so that routine filling and removal of cargo may be accomplished with the bladder system installed. To be compatible with the free floating bladder/skeleton concept, these systems should preferably not penetrate the bladder except from above. Rigid elements leading to the bottom of the tank would also negate the system by possibly puncturing the bladder in an accident.

Cost—Fabrication and installation of the various components of the system are likely to be very expensive. In particular, the assembly of the meso-skeleton will be quite labor intensive and likely to be costly. Additional cost impacts will result from the structural modifications to the Main Deck to install the hinged access doors, from the additional overhaul period necessary to install the system, and from any other modifications or removals of existing ships structure, piping equipment that may also be necessary to facilitate the installation of the system.

Reduced Cargo Carrying Capacity—Due to the fact that the bladder and meso-skeleton system will not wrap around the smaller bulkhead and deck stiffeners, and due to the actual volume of the bladder and meso-skeleton themselves, a percentage of the cargo tank volume can, most likely, not be utilized for oil. For the baseline tanker considered in this report, the overall tank capacity will be reduced by approximately 6%. This figure will vary for tankers of differing sizes or configurations.

Loss of Available Deck Space—Available space on the Main Deck will be significantly reduced by the presence of the oil overflow containment system header pipe and the clearance necessary for the attached containment bags to expand and be transferred over the side of the ship.

Tank Preservation—With the bladder system in place, the interior tank structure will no longer be in direct contact with the oil, but instead will be exposed to a damp, salty, and corrosive atmosphere. Preservative coatings will need to be applied in the tank spaces. These coatings will need to be frequently renewed as a result of metal-to-metal contact between the meso-skeleton and the tank structure that will probably harm the coatings.

Deck Access—Large hatches will need to be provided in the main deck, above each cargo tank, to facilitate the initial installation of the meso-skeleton and the installation and removal of the containment system bladders.

Inert Gas System—The existing inert gas system for tanks would have to be modified to provide for inert gas both inside and outside of the bladders. Although the bladder system will normally isolate the cargo from the internal tank structure, and thereby reduce the chance of an explosion during an accident, it is likely that over time, small quantities of fuel or vapor, originating from the area of the bladder/overflow pipe attachment, will accumulate in the atmosphere outside of the bag but inside the tank. Such vapors could be ignited form a spark generated from the metal-to-metal contact of the meso-skeleton against the tank structure.

Tank Cleaning System—It may be possible to remove the tank cleaning system if it is feasible to change the bladders easily and inexpensively.

Inspection Safety—The ability to remove the bladders while in port would reduce the danger currently experienced for inspection personnel exposed to dangerous solvents within an enclosed area. However, the length of time needed to conduct inspections will increase because the presence of the meso-skeleton will make inspection of the tank structure more difficult to accomplish (impossible without moving meso-skeleton aside).

Reduced Full Load Ship Displacement—Although the bladder and meso-skeleton add weight to the ship, this addition is more than offset by the reduction in weight resulting from the reduced quantity of oil being carried. The resulting full load ship displacement will be about 4400 LT less than a similar tanker that is not outfitted with the system. This quantity will also vary for tankers of differing sizes or configurations. This reduced full load ship displacement may result in a slight increase in fuel economy for the tanker.

A conventional cargo heating system should be provided for the bladder to facilitate removal of oil.

What is claimed is:

1. An apparatus for containing cargo during a hull breach on a ship, comprising: a non-permeable flexible bladder mounted within said ship in which said cargo is disposed; and a skeleton adjacent to said flexible bladder comprised of a plurality of relatively moveable elements for supporting said flexible bladder, said skeleton being flexible and conformable to a shape of said flexible bladder, at least a portion of said skeleton totally surrounding a portion of said flexible bladder, wherein said plurality of relatively moveable elements comprise metallic links.

2. The apparatus of claim 1, further comprising interconnecting links mounted to said metallic plates.

3. The apparatus of claim 1, further comprising: a pressure sensitive valve secured to said non-permeable flexible bladder, said pressure sensitive valve being operable to open to release said cargo in response to a sudden increase in pressure in said non-permeable bladder due to said hull breach.

4. The apparatus of claim 3, further comprising: a plurality of tanks each being much smaller than said flexible bladder, said pressure sensitive valve releasing said cargo into said plurality of tanks.

5. The apparatus of claim 4, wherein each of said plurality of tanks is expandable.

6. The apparatus of claim 3, further comprising: a header for receiving said cargo from said pressure sensitive valve responsive to said hull breach.

7. The apparatus of claim 3, further comprising: at least one expandable tank for receiving said cargo from said pressure sensitive valve responsive to said hull breach.

8. An apparatus for containing cargo during a breach of a wall of a shipping container, comprising: a non-permeable flexible bladder mounted within said shipping container; and a cover within said shipping container for supporting said flexible bladder, said cover being flexible and conformable to a shape of said flexible bladder; and A pressure sensitive valve secured to said non-permeable flexible bladder, said pressure sensitive valve being operable to open to release said cargo in response to a sudden increase in pressure in said non-permeable bladder due to said wall breach.

9. The apparatus of claim 8, further comprising: at least one tank, said pressure sensitive valve releasing said cargo into said at least one tank.

10. A method for containing cargo during a hull breach on a ship, comprising: releasing cargo from a flexible container through a valve in response to increased pressure in said flexible container produced by said hull breach; and directing said released cargo into a header on said ship.

11. The method of claim 10, further comprising: filling at least one expandable tank from said released cargo in said header.

12. The method of claim 11, further comprising: releasing said at least one expandable tank overboard after being filled with said released cargo.

13. The method of claim 10, further comprising: supporting said flexible container with a plurality of support elements flexibly interconnected together.

14. The method of claim 10, further comprising: filling a plurality of expandable tanks from said released cargo in said header.

15. An apparatus for containing cargo during a hull breach on a ship, comprising: a non-permeable bladder mounted within said ship in which said cargo is disposed; a flexible support structure in surrounding relationship to said non-permeable bladder; and a valve secured to said bladder, said valve being operable to open for releasing said cargo through said valve responsive to said hull breach.

16. The apparatus of claim 15, wherein said flexible support structure comprises a plurality of elements moveably linked together.

17. The apparatus of claim 15, further comprising: at least one expandable tank, said at least one expandable tank being in communication with said valve for filling in response to said hull breach.

18. The apparatus of claim 15, wherein said valve is operable for opening responsively to an increase in pressure in said bladder resulting from said hull breach.

19. The apparatus of claim 15, further comprising: a header pipe secured to said valve for receiving said cargo responsive to said hull breach.

20. The apparatus of claim 19, further comprising: a plurality of expandable tanks secured to said header for receiving said cargo responsive to said hull breach.

21. Apparatus for containing cargo during a hull breach on ships comprising:

a non-permeable flexible bladder mounted within said ship in which said cargo is disposed; and a cover for supporting said flexible bladder, said cover being flexible and conformable to a shape of said flexible bladder; and A pressure sensitive valve secured to said non-permeable flexible bladder, said pressure sensitive valve being operable to open to release said cargo in response to a sudden increase in pressure in said non-permeable bladder due to said hull breach.

22. The apparatus of claim 21, further comprising: at least one tank being smaller than said flexible bladder, said pressure sensitive valve releasing said cargo into said at least one tank.

23. The apparatus of claim 22, wherein said at least one tank is expandable.

24. The apparatus of claim 23, further comprising: a header for receiving said cargo from said pressure sensitive valve responsive to said hull breach.

* * * * *